US005862844A

United States Patent [19]

Perrin

[11] Patent Number: 5,862,844

[45] Date of Patent: Jan. 26, 1999

[54] METHODS AND SYSTEMS FOR CONTROLLING A DISPENSING APPARATUS

[75] Inventor: Randall Lee Perrin, Cadillac, Mich.

[73] Assignee: Nartron Corporation, Reed City, Mich.

[21] Appl. No.: 642,792

[22] Filed: May 3, 1996

[51] Int. Cl.[6] ..... B65B 1/04; B65B 3/04

[52] U.S. Cl. ..... 141/351; 141/361; 141/192; 222/52

[58] Field of Search ..... 141/351, 360, 141/361, 192, 198; 222/52; 4/623; 250/221, 222.1

[56] References Cited

U.S. PATENT DOCUMENTS 3,532,886 10/1970 Kruger, Jr. et al. ..... 250/222.1
5,025,516 6/1991 Wilson ..... 4/623
5,243,326 9/1993 Disabato ..... 250/221
5,349,993 9/1994 Casey ..... 222/52

*Primary Examiner*—Steven O. Douglas
*Attorney, Agent, or Firm*—Brooks & Kushman P.C.

[57] ABSTRACT

A system for controlling a dispensing apparatus having a dispensing outlet includes a first illumination source having a first field of illumination, a second illumination source having a second field of illumination, at least one optical sensor, and a control circuit. The control circuit is responsive to the at least one optical sensor to initiate dispensing of a material through the dispensing outlet when the at least one optical sensor senses a portion of a receiving member positioned within the first field of illumination and the second field of illumination. An alternative embodiment utilizes a single illumination source, a plurality of optical sensors, and a control circuit. Here, dispensing can be initiated when a portion of the receiving member is within the fields of view of the plurality of optical sensors.

116 Claims, 20 Drawing Sheets

METHODS AND SYSTEMS FOR CONTROLLING A DISPENSING APPARATUS

TECHNICAL FIELD

The present invention relates to methods and systems for controlling a dispensing apparatus, and methods and systems for proximity sensing therefor.

BACKGROUND OF THE INVENTION

Various types of dispensing systems or dispensing appliances are utilized for dispensing a predetermined material into a receiving member. One type of dispensing appliance commonly encountered is a beverage-dispensing appliance. Beverage-dispensing appliances are utilized to dispense a beverage, which can include ice, water, and syrup, into a receiving member having the form of a cup.

In general, a dispensing appliance can dispense any type of predetermined material. The predetermined material can include a fluid (such as a liquid or a gas), a solid, or both. In typical applications, the receiving member has the form of a container used to contain the predetermined material.

Traditional commercial and domestic dispensing systems have utilized a mechanically actuated switch to initiate and inhibit the dispensing of the predetermined material into the receiving member. For example, many beverage-dispensing appliances include a switch which is actuated by a force applied by a cup in a beverage-receiving position. Actuation of the switch initiates the dispensing of a beverage, while release of the switch inhibits dispensing. Other beverage-dispensing appliances include a switch on a front panel which initiates the dispensing process.

Both of these approaches necessitate continuous contact of the dispensing actuator, through touch, to control the dispensing process.

SUMMARY OF THE INVENTION

It is an object of the present invention is to provide a touch-free method and system for controlling a dispensing apparatus.

Another object of the present invention is to provide precise appliance dispensing control in automated cycles.

A further object of the present invention is to provide a modular system for controlling a dispensing appliance which integrates within existing dispensing structural configurations.

A still further object is to provide a dispensing control system whose actuation sensitivity can be programmed to allow customization of the process for initiating, maintaining and terminating the dispensing cycle to each dispensing apparatus.

Yet another object of the invention is to provide an electronic circuit specifically designed to actuate a dispensing appliance from above when a container is presented directly below an outlet.

An additional object is to provide a low cost circuit to provide a position-dependent response.

These objectives are met by the various aspects of the invention. In one aspect, the present invention provides a system for controlling a dispensing apparatus having a dispensing outlet. The system includes a first illumination source having a first field of illumination, a second illumination source having a second field of illumination, at least one optical sensor, and a control circuit. The control circuit is responsive to the at least one optical sensor to initiate dispensing of a material through the dispensing outlet when the at least one optical sensor senses a portion of a receiving member positioned within the first field of illumination and the second field of illumination.

Infrared sensing is preferably employed to minimize ambient light interference and noise. Here, infrared light emitting diodes which form the illumination sources are driven with a low duty-cycle on-time. The emitter diodes are preferably always driven with a low duty cycle which may be increased during dispensing, but will still remain small. This results in an increased component life, a higher signal-to-noise ratio, and an improved noise rejection.

According to another aspect the present invention, the illumination intensity of the illumination sources is increased when dispensing is initiated in order to improve system response during dispensing.

According to yet another aspect of the invention, the control circuit operates from the same electrical power source as the dispensing appliance. Here, the control circuit can utilize an alternating current (AC) line frequency as an input for dispenser timing, ambient light noise cancellation, and a dispenser disable feature for appliance dispenser inspection, cleaning, maintenance, and repair.

According to a further aspect of the invention, the illumination sources include a structurally stepped infrared emitter diode array to provide an increased sensitivity gradient as the receiving member is moved from the front to the rear of the dispenser. Using this approach, the same sensor serves for detecting and establishing container presentation in the vicinity of the dispenser outlet. Further, the sensor can be utilized for wide variations in container presentation method, container size, and material compositions, e.g., glass, paper, tin, or poly-plastic.

In an additional aspect of the invention, the optical sensors are located in stepped recesses within the sensor housing. Here, the walls of the recesses function as aperture stops to limit and control the solid angle of view of the optical sensors. This, in combination with at least one illumination source that may or may not be stepped, allows for proximity detection and location detection beneath the dispenser outlet.

In one embodiment, according to yet another aspect of the invention, such a sensor system array provides the means for proximity sensing of end-use packaging in product dispensing applications.

These and other features, aspects, and advantages of the present invention will become better understood with regard to the following description, appended claims, and accompanying drawings.

BRIEF DESCRIPTION OF THE DRAWINGS

FIGS. 17A–17E illustrate a schematic diagram of an embodiment of a control circuit in accordance with the present invention.

DETAILED DESCRIPTION OF A PREFERRED EMBODIMENT

Figure 1:
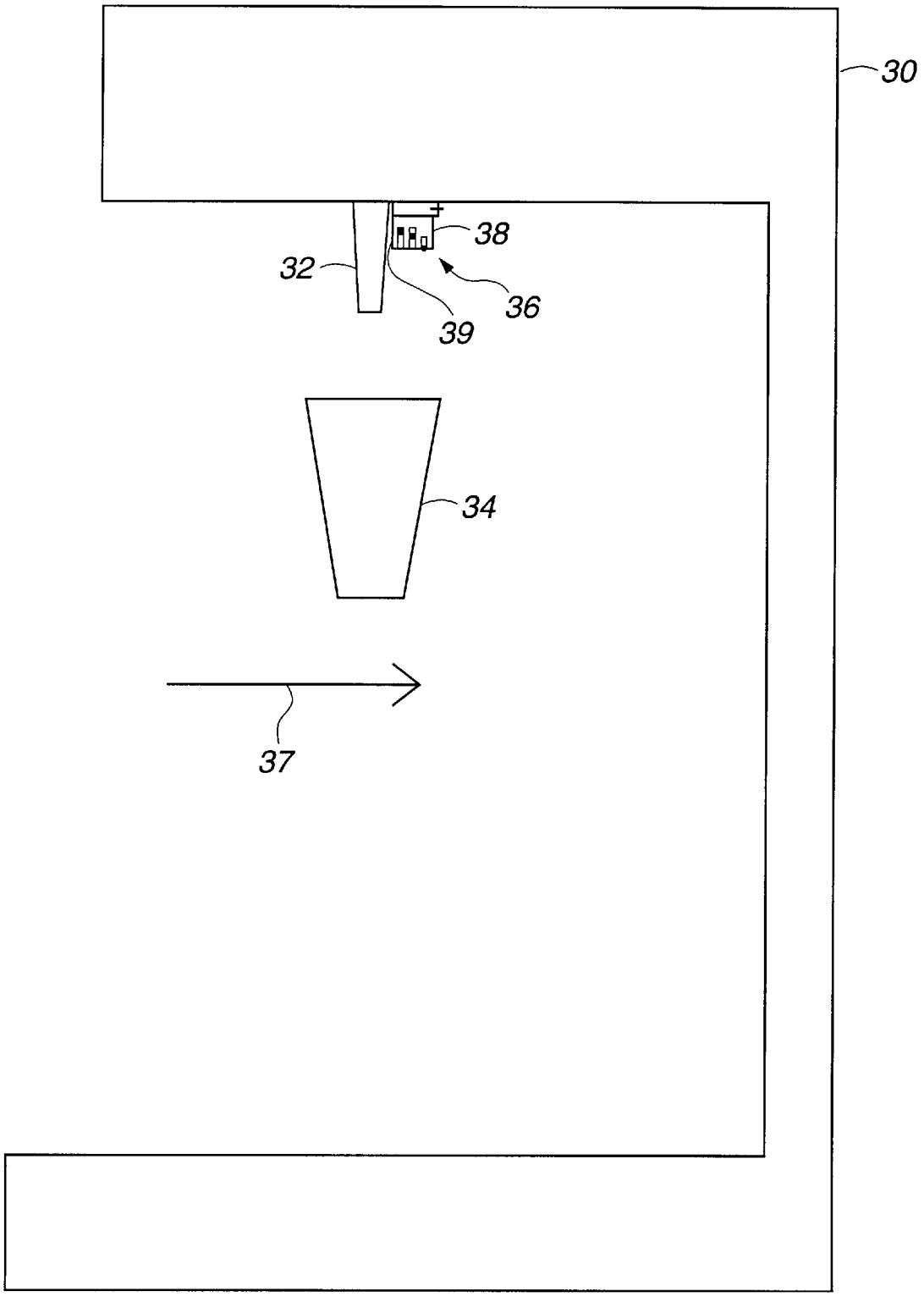
FIG. 1 illustrates an embodiment of a system for controlling a dispensing apparatus having a dispensing outlet.

Referring now to FIG. 1, there is shown an embodiment of a system for controlling a dispensing apparatus 30 having a dispensing outlet 32. The dispensing outlet 32 is utilized to dispense a material into a receiving member 34.

The dispensing apparatus 30 can take the form of a modular appliance which is to dispense fluid or solid materials into the receiving member 34 when the receiving member 34 is underneath the dispensing outlet 32. For example, as illustrated, the dispensing apparatus 30 can be utilized to dispense a beverage into a receiving member 34 having the form of a cup. However, the dispensing apparatus 30 can be utilized, in general, for a wide range of applications requiring controlled dispensing and containerization of solids, liquids or gases, such as ice, water, syrups and carbonated beverages, into the receiving member 34 for containing the material. Hence, the dispensing apparatus 30 and the receiving member 34 can have different forms than those illustrated based upon the particular application. For example, the receiving member 34 have forms which include, but are not limited to, cartons, boxes, bulk packs, or the like. The dispensing apparatus 30 can be utilized for dispensing any end-use product into these types of receiving members. It is further noted that the dispensing apparatus 30 may be utilized for domestic, commercial and/or industrial applications.

In a preferred embodiment, the system includes a dispenser control module 36 which is mounted alongside and above the dispenser outlet 32. It is also preferred that the dispenser control module 36 be located behind the dispensing outlet 32 with respect to a direction 37 of presenting the receiving member 34 to the dispensing apparatus 30.

The dispenser control module 36 includes a sensor array 38 to sense the receiving member 34 when the receiving member 34 is presented to receive a material from the dispensing outlet 32. Preferably, the sensor array 38 is located near to the dispensing outlet 32 to instantaneously actuate the dispensing mechanism when the receiving member 34 is presented. To aid in describing the orientation of the sensor array 38 in subsequent drawings, a side 39 of the sensor array 38 adjacent to the dispenser outlet 32 is defined.

The dispenser control module 36 further includes a control circuit (not specifically illustrated) operatively associated with the sensor array 38. The control circuit is operative to initiate dispensing of the material through the dispensing outlet 32 when a portion of the receiving member 34 is sensed by the sensor array 38. The control circuit can perform additional functions as described herein.

It is preferred that the dispenser control module 36 be powered by a power source provided by the dispensing apparatus 30. At the illustrated location, a nominal 24 volts alternating current source is available in various types of dispensing apparatus 30. Here, it is preferred that the dispenser control module be powered by this 24 volt AC source. It is noted, however, that alternative embodiments of the dispenser control module 36 can be powered in alternative manners.

Figure 2:
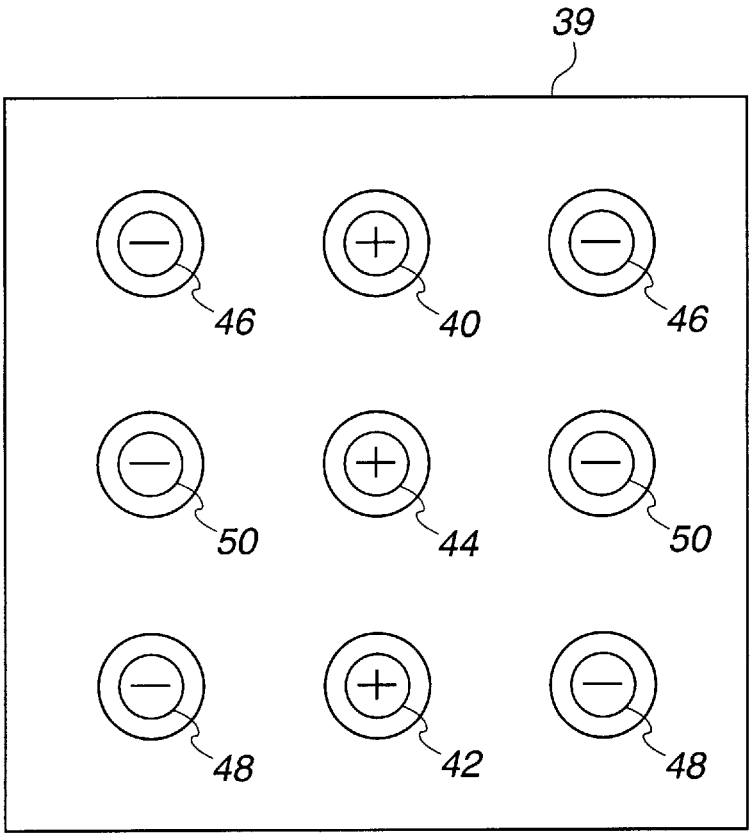
FIG. 2 illustrates a bottom view of an embodiment of a sensor array in accordance with the present invention.

FIG. 2 is a bottom view illustration of an embodiment of a sensor array in accordance with the present invention. The sensor array includes a first illumination source 40, a second illumination source 42, and a third illumination source 44. The first illumination source 40, the second illumination source 42, and the third illumination source 44 are utilized to optically illuminate the receiving member 34 when presented in the dispensing apparatus 30. In a preferred embodiment, each of the first illumination source 40, the second illumination source 42, and the third illumination source 44 includes a respective emitter diode which radiates energy in a predetermined spectrum. More preferably, each respective emitter diode radiates infrared energy.

The sensor array further includes at least one optical sensor which senses a reflection of the energy radiated by the illumination sources 40, 42, and 44. Such a reflection occurs when the receiving member 34 is proximate to the dispensing outlet 32. Hence, it is preferred that the at least one optical sensor have a spectrum of sensitivity consistent with the spectrum of radiation of the illumination sources.

As illustrated, it is preferred that the at least one optical sensor includes a first pair of optical sensors 46, a second pair of optical sensors 48, and a third pair of optical sensors 50. The first pair of optical sensors 46 is located on opposite sides of the first illumination source 40. The second pair of optical sensors 48 is located on opposite sides of the second illumination source 42. The third pair of optical sensors 50 is located on opposite sides of the third illumination source 44. In this way, the sensor array is organized into three columns, where each column has three optical devices. The outside columns contain the optical sensors while the center column contains the illumination sources.

In a preferred embodiment, each optical sensor in the pairs of optical sensors 46, 48, and 50 includes a respective phototransistor which is sensitive to the predetermined spectrum of emission. More preferably, each respective phototransistor is an infrared-sensitive detector. Through the use of a daylight filter and/or AC coupling with a modulated source, each phototransistor can be relatively unaffected by infrared components in natural and artificial lighting.

The receiving member 34, when presented for material dispensing directly under the control module 36, interferes with radiation from the illumination sources 40, 42, and 44 to reflect the radiation into the pairs of optical sensors 46, 48, and 50. Each optical sensor produces a signal indicative of an intensity of a reflected radiation received thereby. The control circuit utilizes these signals to determine when to initiate and/or stop dispensing of the material through the dispensing outlet 32.

Figure 3:
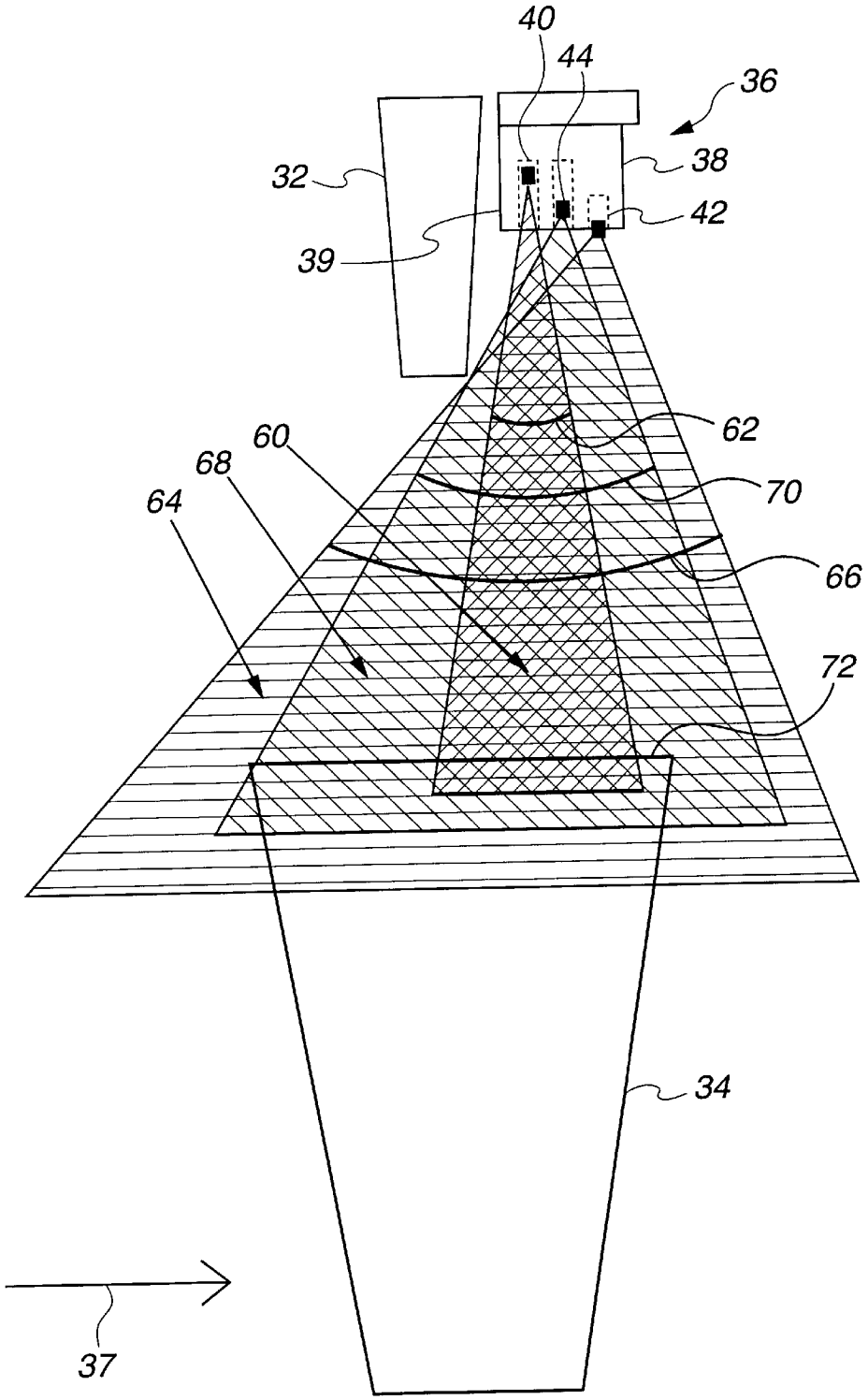
FIG. 3 illustrates emission patterns of the illumination sources in one embodiment of the present invention.

FIG. 3 illustrates emission patterns of the illumination sources 40, 42, and 44 in one embodiment of the present invention. The first illumination source 40 defines a first field of illumination 60 which spans a first solid angle 62. The second illumination source 42 defines a second field of illumination 64 which spans a second solid angle 66. The third illumination source 44 defines a third field of illumination 68 which spans a third solid angle 70.

As the receiving member 34 moves in the direction 37 toward a receiving position under the dispensing outlet 32, a portion thereof is initially illuminated only by the illumination source 42. As the receiving member 34 further approaches the receiving position, a portion of the receiving member 34 becomes illuminated by the illumination source 44 in addition to the illumination source 42. Finally, all three illumination sources 40, 42, and 44 illuminate a portion of the receiving member 34 when at the receiving position. Hence, the reflected return from the receiving member 34 increases as the receiving member 34 moves toward the receiving position. As a result, the detection of the receiving member 34 by the at least one optical sensor is enhanced as the position of the receiving member 34 progresses from the front (at side 39) to the back of the sensor array 38.

The control circuit is designed to initiate the dispensing of the material when the at least one optical sensor senses a portion of the receiving within the first field of illumination 60, the second field of illumination 64, and the third field of illumination 68. More particularly, the dispensing is prevented until an edge 72 of the receiving member 34 enters the first field of illumination 60. The control circuit commands that dispensing be stopped when the edge 72 leaves the first field of illumination 60.

To improve a resulting gradient of sensitivity, it is preferred that the second solid angle 66 be greater than the first solid angle 62, and the third solid angle 70 be greater than the first solid angle 62, but less than the second solid angle 66. The illumination source 42 is directed to illuminate a portion of the receiving member 34 whenever the receiving member 34 is in general proximity to the receiving position. In contrast, the illumination source 40 only illuminates a portion of the receiving member 34 when the receiving member 34 is at the receiving position. As a result, the illumination source 42 is beneficial for general proximity sensing while the illumination source 40 is beneficial for a more accurate determination of when the receiving member 34 is in the receiving position. The resulting gradient of sensitivity coupled with a prioritized sensor sampling when dispensing is enabled (which is described in more detail hereinafter), accomplishes control system hysteresis for a synchronous response of the dispensing cycle with container presentation.

Figure 4:
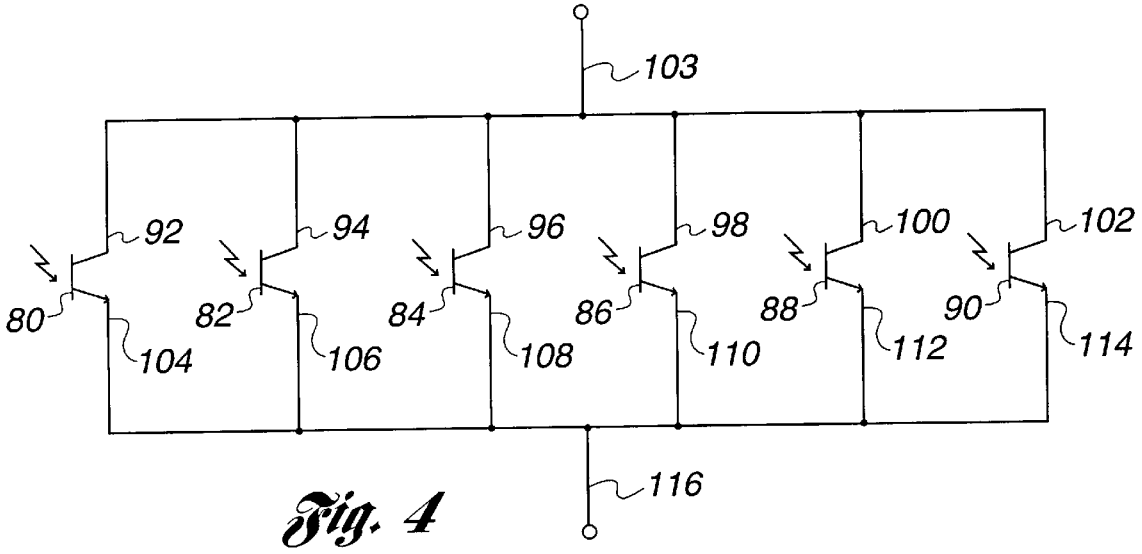
FIG. 4 is a schematic diagram of a parallel interconnection of the at least one optical sensor.
Figure 5:
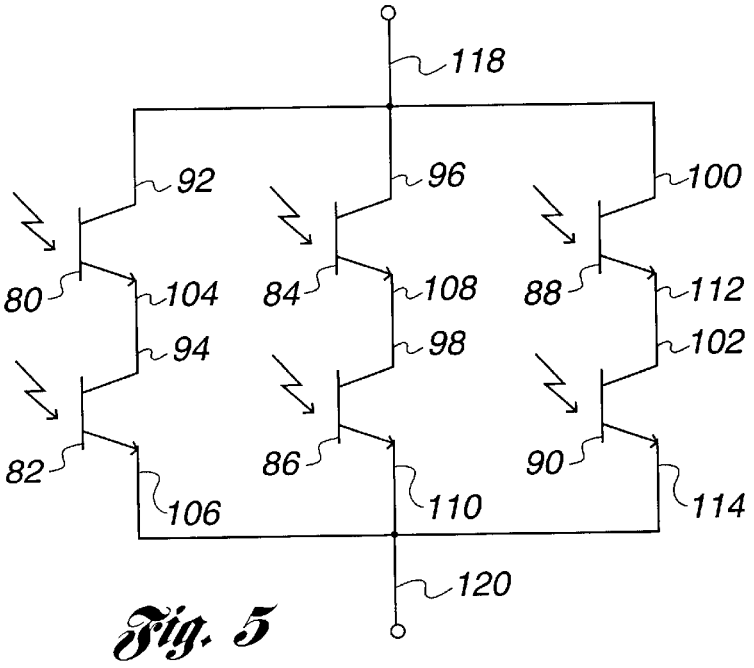
FIG. 5 is a schematic diagram of a mixed, series-parallel interconnection of the at least one optical sensor.
Figure 6:
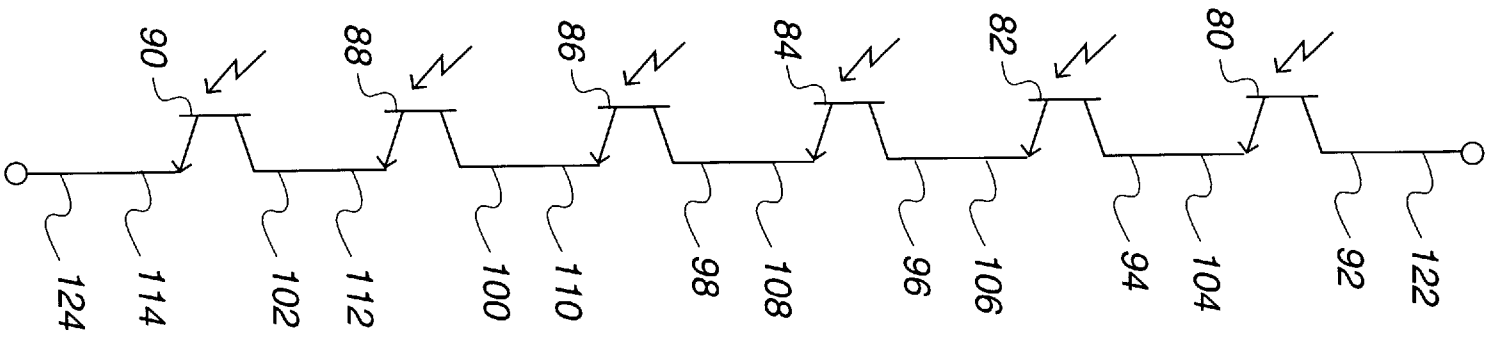
FIG. 6 is a schematic diagram of a series interconnection of the at least one optical sensor.

The at least one optical sensor can be interconnected in a variety of ways to form a single quantity indicative of a location of the receiving member 34 in proximity to the receiving position. FIGS. 4, 5, and 6 illustrate three such interconnections of the at least one optical sensor which provide a current indicative of the location of the receiving member 34. For a purpose of illustration, each of the at least one optical sensor is shown as a phototransistor in these drawings, although other types of optical sensors can be utilized. Phototransistors 80 and 82 correspond to the first pair of optical sensors 46, phototransistors 84 and 86 correspond to the second pair of optical sensors 48, and phototransistors 88 and 90 correspond to the third pair of optical sensors 50.

FIG. 4 is a schematic diagram of a parallel interconnection of the at least one optical sensor. More specifically, collectors 92, 94, 96, 98, 100, and 102 of the phototransistors 80, 82, 84, 86, 88, and 90, respectively, are connected to form a first terminal 103. Emitters 104, 106, 108, 110, 112, and 114 of the phototransistors 80, 82, 84, 86, 88, and 90, respectively, are interconnected to form a second terminal 116. The current flowing between the first terminal 103 and the second terminal 116 indicates a measure of proximity of the receiving member 34.

FIG. 5 is a schematic diagram of a mixed, series-parallel interconnection of the at least one optical sensor. Here, the two phototransistors in each pair of optical sensors are connected in series. In particular, the phototransistors 80 and 82 from the first pair of optical sensors 46 are connected in series, the phototransistors 84 and 86 from the second pair of optical sensors 48 are connected in series, and the phototransistors 88 and 90 from the third pair of optical sensors 50 are connected in series. Each series connection includes a connection of an emitter of one phototransistor to a collector of another phototransistor. The three series combinations which result are interconnected in a parallel combination. The resulting combination has terminals 118 and 120 through which a proximity-dependent current flows.

FIG. 6 is a schematic diagram of a series interconnection of the at least one optical sensor. Here, the phototransistors 80, 82, 84, 86, 88, and 90 are interconnected in series. The resulting series combination has terminals 122 and 124 through which a proximity-dependent current flows.

Regardless of the specific interconnection, if a phototransistor is turned on, a current flow therethrough will increase or decrease as the amount of light reflected thereto increases or decreases. The interconnection determines how these individual currents are combined to form an overall measure of reflected light, or of proximity.

In the series interconnection of FIG. 6, a sufficient amount of reflected light must be received at each phototransistor to turn on each one for current to flow therethrough. Otherwise, no current will flow through the series interconnection. Once all phototransistors are turned on, the current flow will increase or decrease as the amount of light reflected thereto increases or decreases. With the series interconnection, the phototransistors are allowed to operate both as amplifiers and as part of what is effectively a logical AND circuit.

In cases where the levels of reflected light are low or localized, it is desirable to connect the phototransistors in series two at a time with the three pairs driven in parallel (as shown in FIG. 5). This configuration produces a logical AND in each detector pair, but allows current flow if any single pair is illuminated by reflected radiation.

Regardless of the specific interconnection utilized, the control circuit initiates dispensing of the material when a current through an interconnection of the at least one optical sensor exceeds a first threshold. The first threshold is selected to be consistent with an amount of reflected light which occurs when the receiving member 34 is directly beneath the dispensing outlet 32.

In a refinement of this approach, a second threshold, which is less than the first threshold, is utilized to detect when some reflecting object is in the vicinity of the sensor array 38. When the current through the interconnection exceeds the second threshold, the control circuit commands an increased illumination by at least one of the first illumination source 40, the second illumination source 42, and the third illumination source 44. Preferably, the illumination by all of the illumination sources 40, 42, and 44 is increased by this command. The increased illumination can be commanded by driving the illumination sources 40, 42, and 44 with a higher current level.

The current through the interconnection is then compared to the first threshold to infer the presence of the receiving member 34 below the dispensing outlet 32. When the first threshold is exceeded, dispensing of material from the dispensing outlet 32 is initiated. When the current drops below the first threshold, the dispensing of material is inhibited. This refinement is beneficial in producing a higher signal-to-noise ratio when an object is in the vicinity of the sensor array 38, and in increasing the lifetime of the illumination sources by not always driving them at a high level.

In a further enhancement, the control circuit performs a calibration sequence at a predetermined time, such as at power-up, to set system gain. Upon power up, the drive to the illumination sources is increased until the current from the at least one optical sensor rises above a predetermined threshold. Thereafter, the drive can be decreased by a predetermined factor. This enhancement is beneficial in providing a means to compensate for loss of illumination output due to aging, unit to unit variations in illumination output and alignment, and signal losses due to accumulation of surface contamination on the illumination sources and the optical sensors. This enhancement can also be used to set the system for different container types that have differing degrees of reflectivity, e.g., paper vs. plastic vs. Styrofoam.

Figure 7:
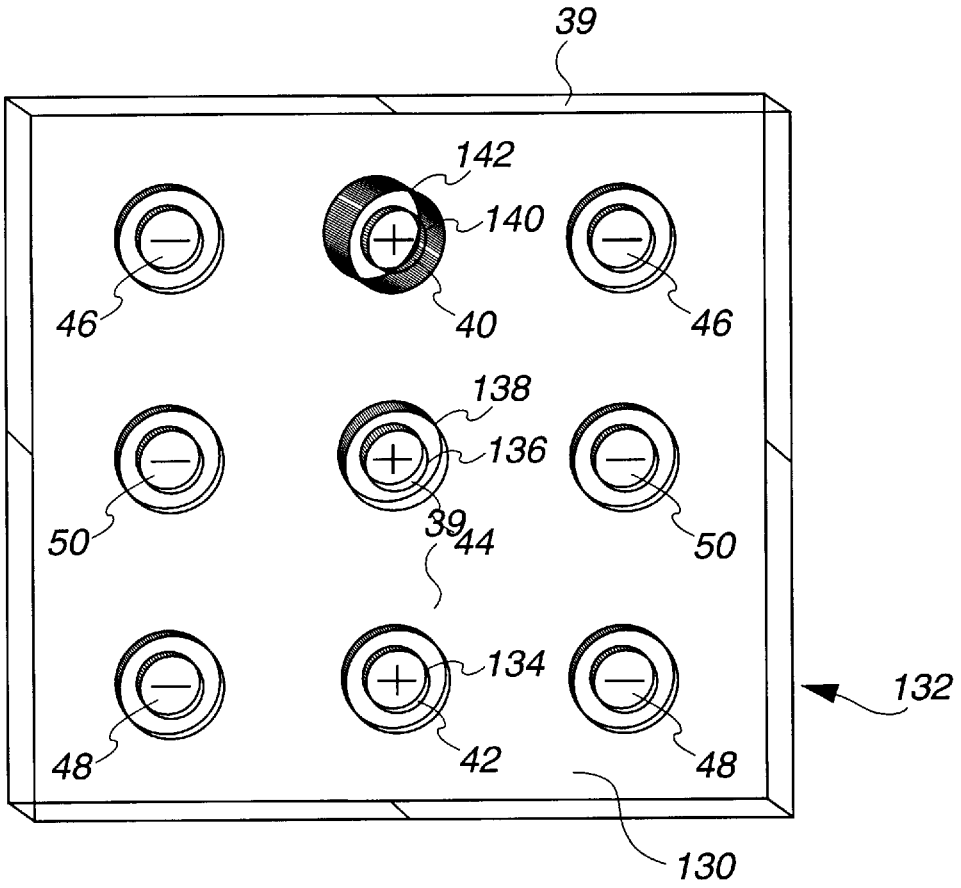
FIGS. 7 and 8 illustrate progressively rotated views of the bottom of the sensor array.
Figure 8:
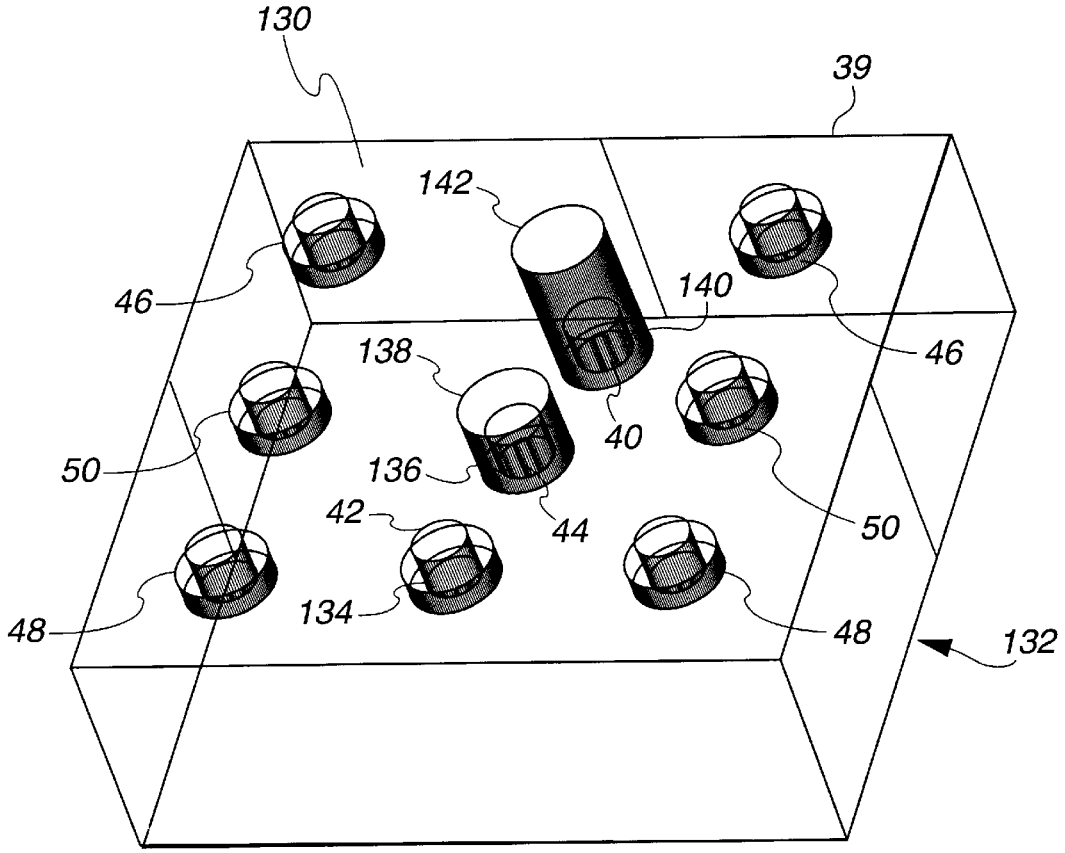

FIGS. 7 and 8 illustrate progressively rotated views of the bottom of the sensor array 38. These views illustrate an approach to mounting the illumination sources 40, 42, and 44 and the pairs of optical sensors 46, 48, and 50 amenable for sensing the edge of the receiving member 34 within a narrow range when presented beneath the dispensing outlet 32. The pairs of optical sensors 46, 48, and 50 are mounted to slightly protrude from a surface 130 of a sensor array housing 132. To provide an added degree of protection, the pairs of optical sensors 46, 48, and 50 can be mounted flush with the surface 130.

The illumination source 42 has an emitter diode 134 mounted to protrude slightly from the surface 130. The illumination source 44 has an emitter diode 136 mounted within a recess 138 in the surface 130. The illumination source 40 has an emitter diode 140 mounted within a recess 142 in the surface 130. The emitter diode 140 is mounted at greater depth with respect to the surface in comparison to depth at which the emitter diode 136 is mounted. As a result, the emitter diodes 134, 136, and 140 are mounted with progressive increasing degrees of depth with respect to the surface 130. It is noted that, in general, all of the emitter diodes 134, 136, and 140 can be mounted at or below the surface 130 of sensor array 38 at preselected varying depths. By mounting in recesses 138 and 142 within the sensor array 38, the walls of the recesses 138 and 142 act as aperture stops to control the solid angle of illumination from the emitter diodes 136 and 140.

By mounting the emitter diodes as illustrated, the emission of the emitter diode 134 is limited only by the spatial emission distribution of the emitter diode 134 and the presence of the dispensing outlet 32. The emitter diode 140 is placed the deepest within the sensor array housing 132 and so has the most constrained emission pattern. The emission pattern of the emitter diode 136 is less constrained than that of the emitter diode 140, but more constrained than that of the emitter diode 134.

Figure 9:
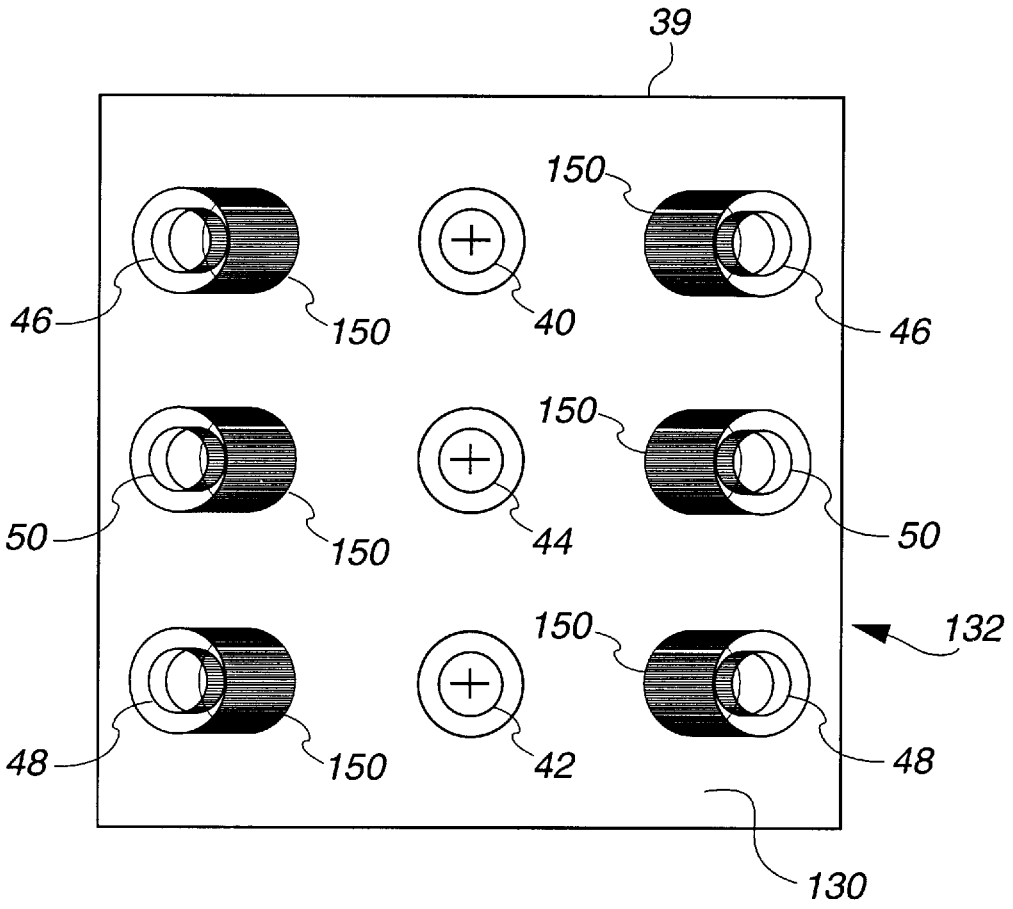
FIGS. 9 to 11 illustrate progressively rotated views of the bottom of an alternative embodiment of the sensor array.
Figure 10:
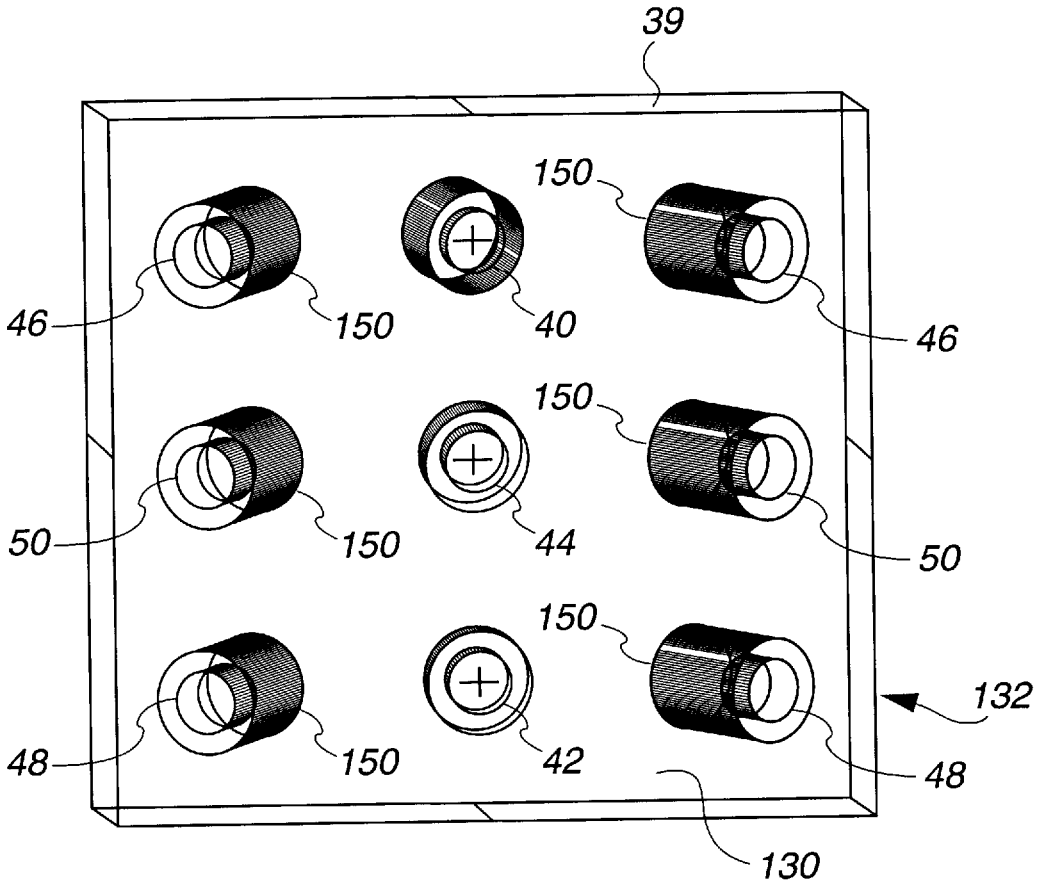
Figure 11:
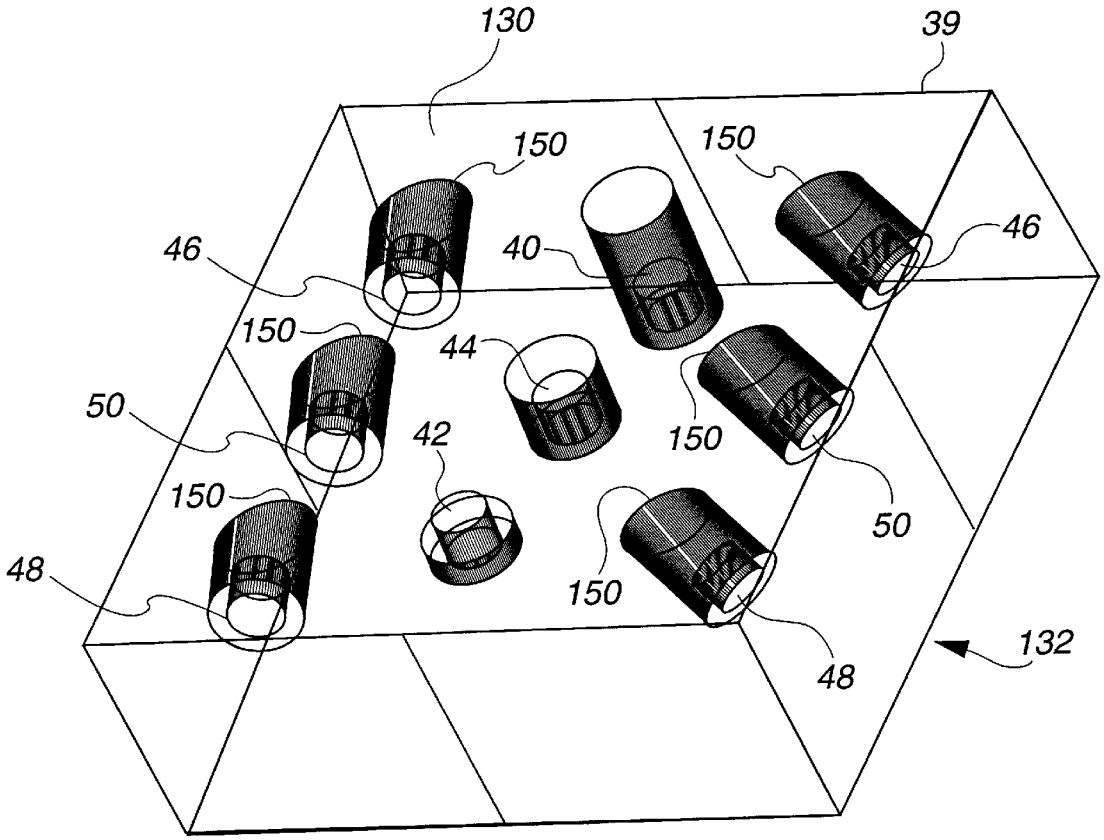

FIGS. 9 to 11 illustrate progressively rotated views of the bottom of the sensor array having an alternative mounting technique. The illumination sources 40, 42, and 44 are mounted in a manner similar to the embodiment of FIGS. 7 and 8. In this embodiment, however, the pairs of optical sensors 46, 48, and 50 are mounted within aperture limiting recesses 150. Further, each optical sensor is inclined in order to define a predetermined region of maximal reflected signal.

Figure 12:
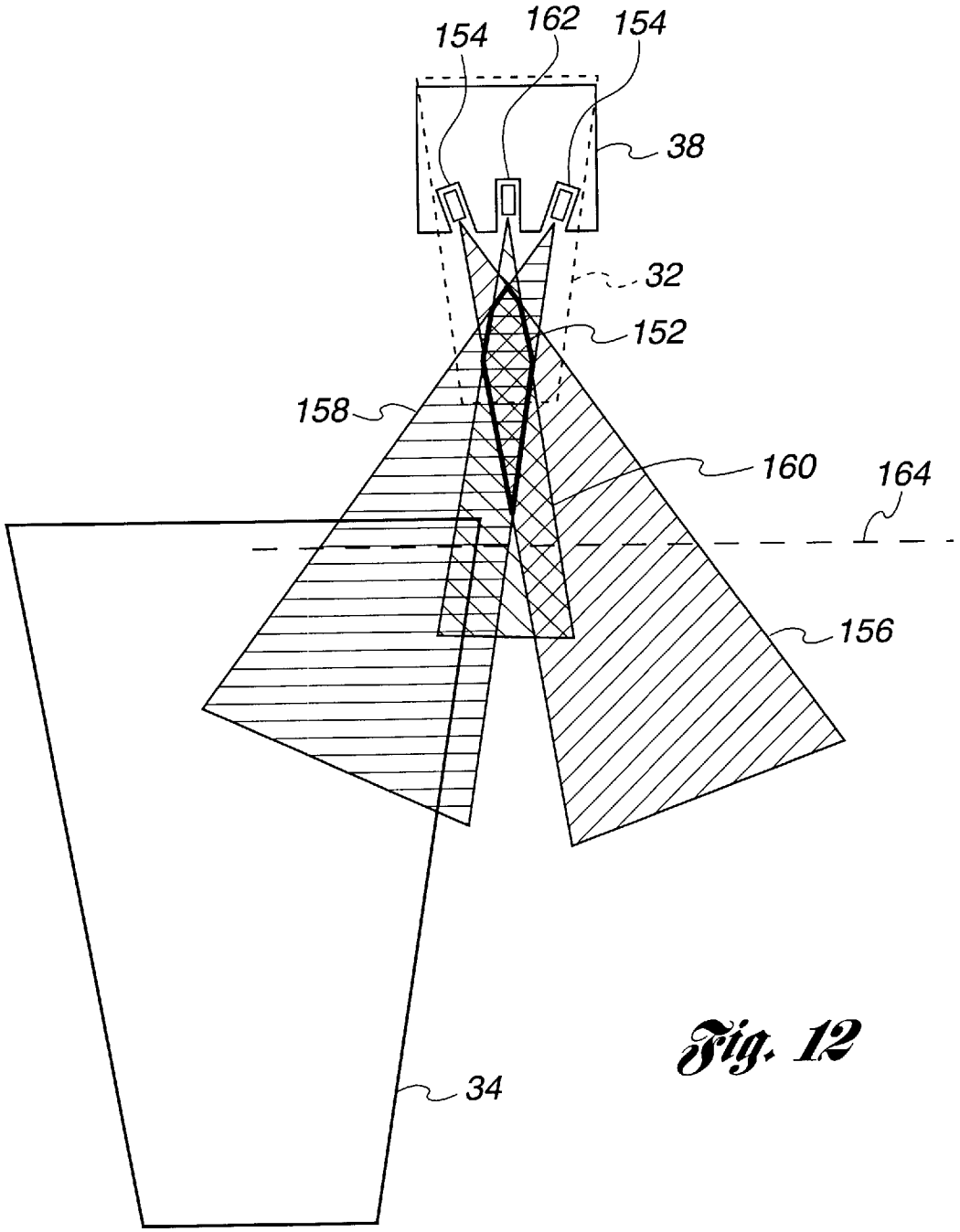
FIG. 12 shows a region of maximal reflected signal for one pair of optical sensors in the embodiment of FIGS. 9 to 11.

FIG. 12 illustrates a region 152 of maximal reflected signal for one pair of optical sensors 154. The region 152 of maximal reflected signal is defined as the intersection of fields of view 156 and 158 of the pair of optical sensors 154, and a field of illumination 160 of an illumination source 162. As can be seen, this provides a localized region of sensitivity with respect to both a horizontal and a vertical position of the receiving member 34. If the receiving member 34 is presented too far below the dispensing outlet 32, such as below a level 164, no portion thereof falls within the region 152. Similarly, if the receiving member 34 is presented at too great an offset in a direction normal to the plane of FIG. 1, the receiving member 34 will be to the left or right of the region 152. For example, the receiving member 34 illustrated in FIG. 12 is offset from the dispensing outlet 32 (which is illustrated in phantom). In both of the above-described cases, the reflected signal detected by the optical sensors 154 is reduced in comparison to when a portion of the receiving member 34 is within the region 152.

It is noted that the view in FIG. 12 is in a direction normal to that in FIG. 1, and that the dispensing outlet 32 can be either behind or in front of the sensor array 38 in this view.

Figure 13:
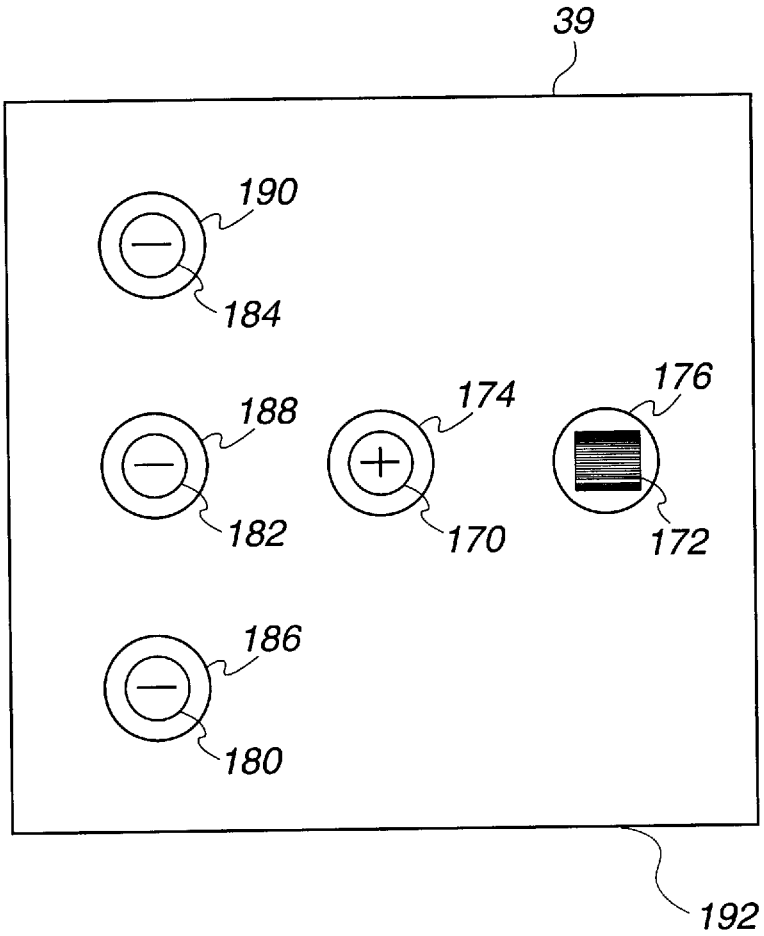
FIGS. 13 to 15 illustrate progressively rotated views of the bottom of another sensor array in accordance with the present invention.
Figure 14:
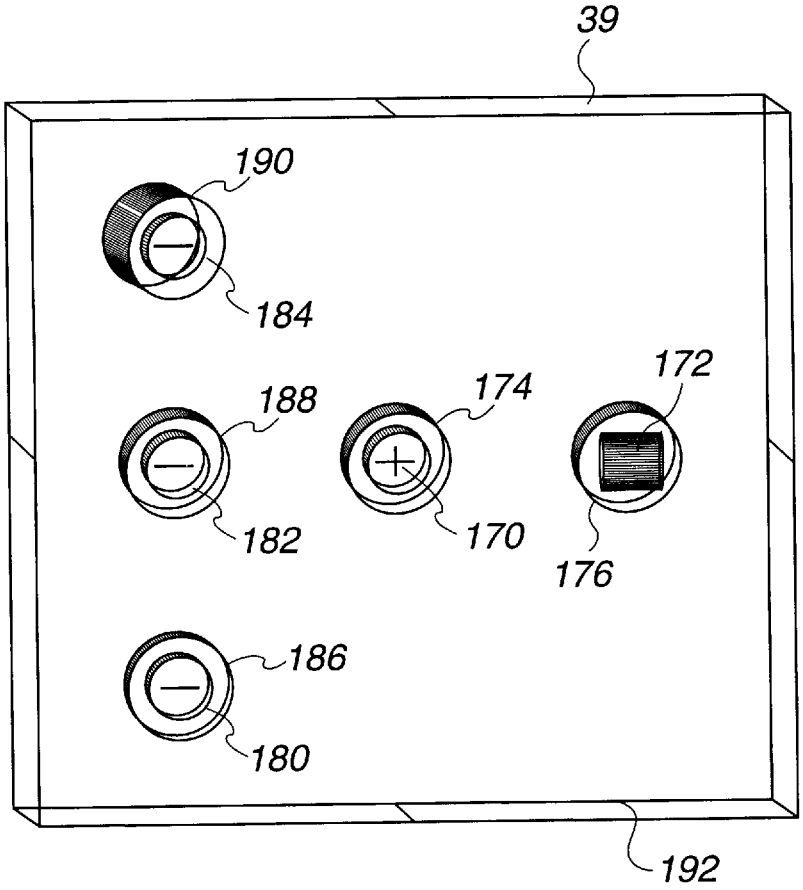
Figure 15:
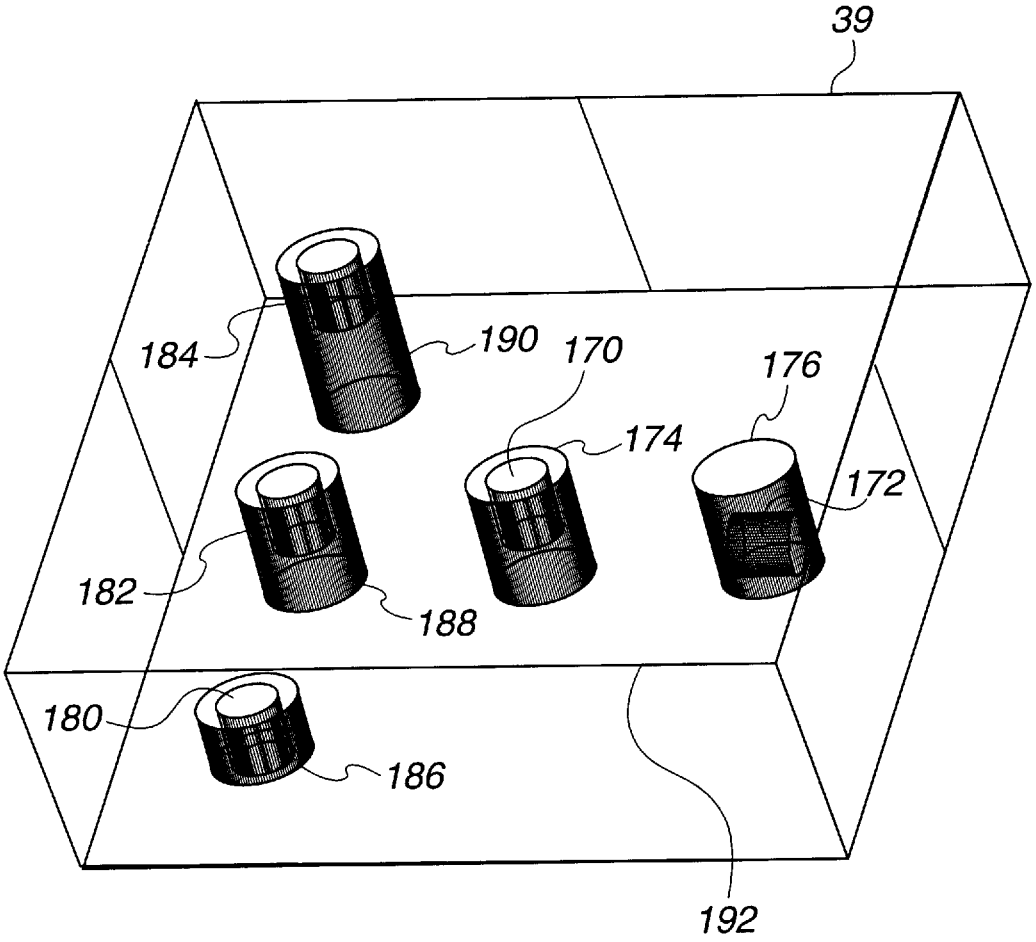

FIGS. 13 to 15 illustrate progressively rotated views of the bottom of another sensor array in accordance with the present invention. In this configuration, a single illumination source 170, which can include an emitter diode as described earlier, is placed in the center of the array. A reference sensor 172, which can include a phototransistor as described earlier, is situated to view direct radiation from the illumination source 170, but to have its view of the field below the sensor array obstructed. This can be accomplished by orienting the reference sensor 172 on its side as shown. Transmission to the reference sensor 172 from the illumination source 170 is enhanced by locating mounting recesses 174 and 176 of the illumination source 170 and the reference sensor 172, respectively, close together. Alternatively, an aperture slot (not specifically illustrated) can be defined through a section of housing between the illumination source 170 and the reference sensor 172 for the same purpose.

Using this configuration, the output of the reference sensor 172 is compared to a constant reference and the difference is negatively fed back to a driver circuit for the illumination source 170. In this way, a constant illumination intensity is maintained for the illumination source 170 independent of aging or temperature effects therein.

A first optical sensor 180, a second optical sensor 182, and a third optical sensor 184 are mounted in progressively deeper recesses 186, 188, and 190 from a back side 192 to the front side 39. This converts the fields of illumination 60, 64, and 68 in FIG. 3 to three fields of view. A series connection of the optical sensors 180, 182, and 184 or an explicitly coincident logic circuit is used to require simultaneous signals corresponding to reflected radiation in each of the three fields of view.

In a further refinement, reception of a signal above a predetermined threshold can be used as a trigger to command an increased illumination intensity by the illumination source 170. For example, if the signal received by the optical sensor 182 is above a predetermined threshold, the control circuit can initiate a detection mode wherein coincidence circuitry is enabled and/or a drive current to the emitter diode is boosted. Thereafter, another threshold can be utilized to detect when the receiving member 34 is at the receiving position. As a result, a dual threshold arrangement such as that described in a previous embodiment can be employed. Use of the detection mode allows the system to use less power and to increase the life of the illumination source 170 when no objects are in the vicinity of the sensor array 38.

Figure 16:
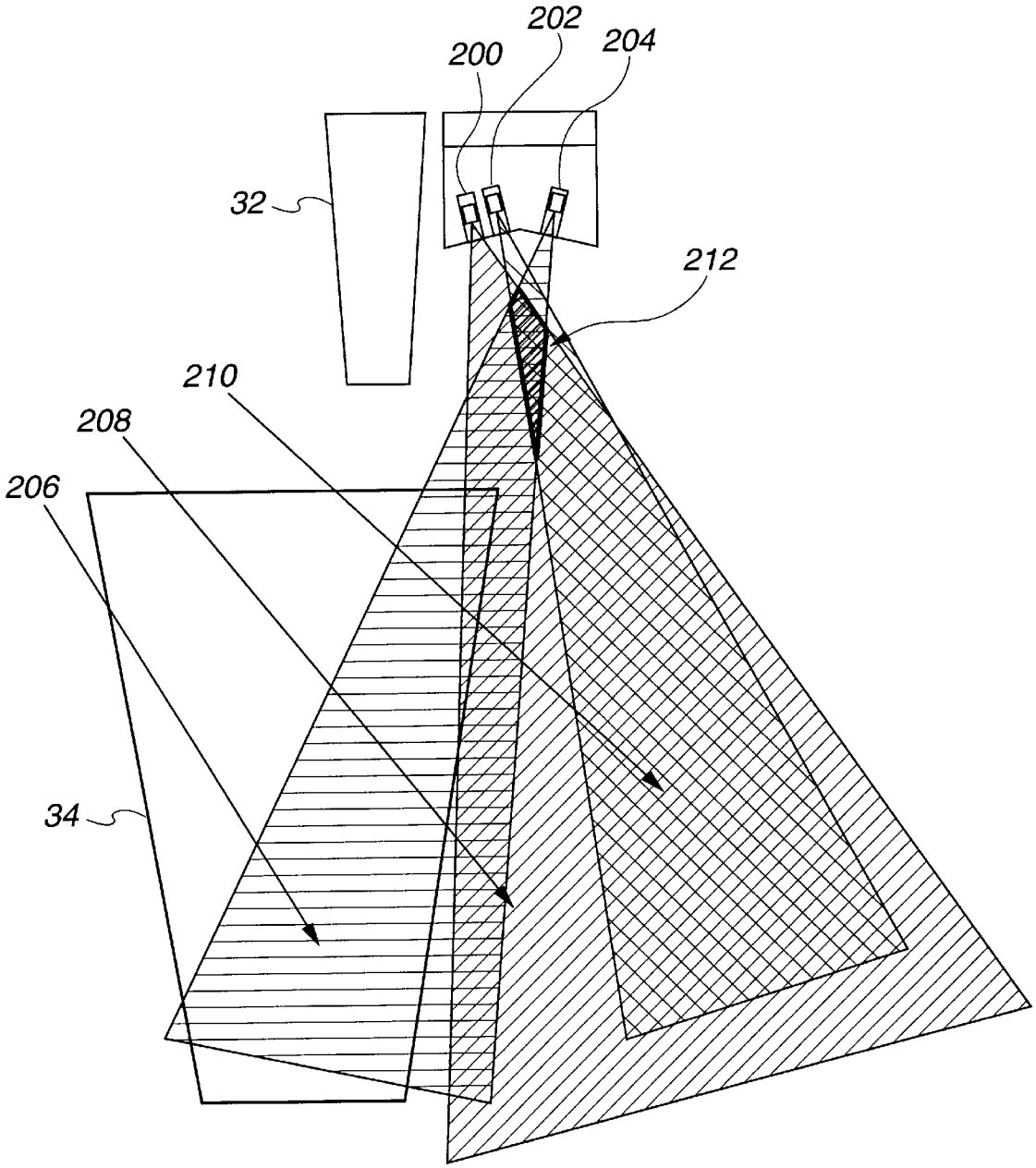
FIG. 16 illustrates an alternative arrangement of a pair of optical sensors and an illumination source in a sensor array.

FIG. 16 illustrates an alternative arrangement of a pair of optical sensors 200 and 202, and an illumination source 204 in a sensor array. In this embodiment, the illumination source 204 defines a field of illumination 206, while the optical sensors 200 and 202 define fields of view 208 and 210, respectively. The intersection of the field of illumination 206 and the field of view 208 provides a region where the presence of an object, such as the receiving member 34, can produce a signal in the optical sensor 200. This signal can be compared to a first lower threshold to infer the possible presence of an object, and thereafter to trigger a detection mode where an emitter drive boost and/or other associated electronic and logic modes are enabled.

Region 212 shows where the fields of view 208 and 210, and the field of illumination 206 all intersect. When an object, such as the receiving member 34, enters this region, signals will be received from both of the optical sensors 200 and 202. Again, by using an explicit coincidence circuit or a series connection of the optical sensors 200 and 202, the simultaneous reception of a signal in both sensors can be used to infer the presence of the receiving member 34 below the dispensing outlet 32, and to subsequently initiate delivery from the dispensing outlet 32. If the receiving member 34 is outside of the region 212, no simultaneous signal is received, and hence, delivery is not initiated or is stopped if already initiated.

It is noted that the shape and extent of the regions of intersection can be manipulated by controlling the angle of inclination and depth of placement of the optical sensors 200 and 202, and the illumination source 204.

Many possible variations of sensor array configurations not found in the specifically-described embodiments can be carried out without departing from the principles of the invention. For example, embodiments of the invention can be utilized to sense opaque liquid containers by sensing the bottom of the container rather than a top edge of the container. Here, sensing of the bottom of the container initiates dispensing. As a result, a high-repeatability of detection can be attained using a sensor element configuration placed above the container.

Further, in any of the various embodiments of the present invention, the illumination sources can be driven by either a continuous wave signal or a pulsed signal. Driving the illumination sources with low-duty-cycle pulses is advantageous in reducing power consumption and prolonging emitter life. Low-duty-cycle pulses occurring at a sufficiently high repetition rate are also beneficial for improving a resulting signal-to-noise ratio. For infrared sensing, infrared background noise is caused by daylight, which produces a DC background signal, and/or by artificial lighting which tends to produce a 120-Hz background. The signals sensed by the optical sensors can be high-pass filtered to pass the pulsed signal, and to remove the DC and 120 Hz background IR radiation noise.

The low duty cycle is also advantageous in that the illumination source can be instantaneously driven much harder than is possible with a higher duty cycle. This results in a higher peak illumination for the same average illumination. Consequently, an improved signal-to-noise ratio, and hence, an enhanced performance is produced.

Figure 17A:
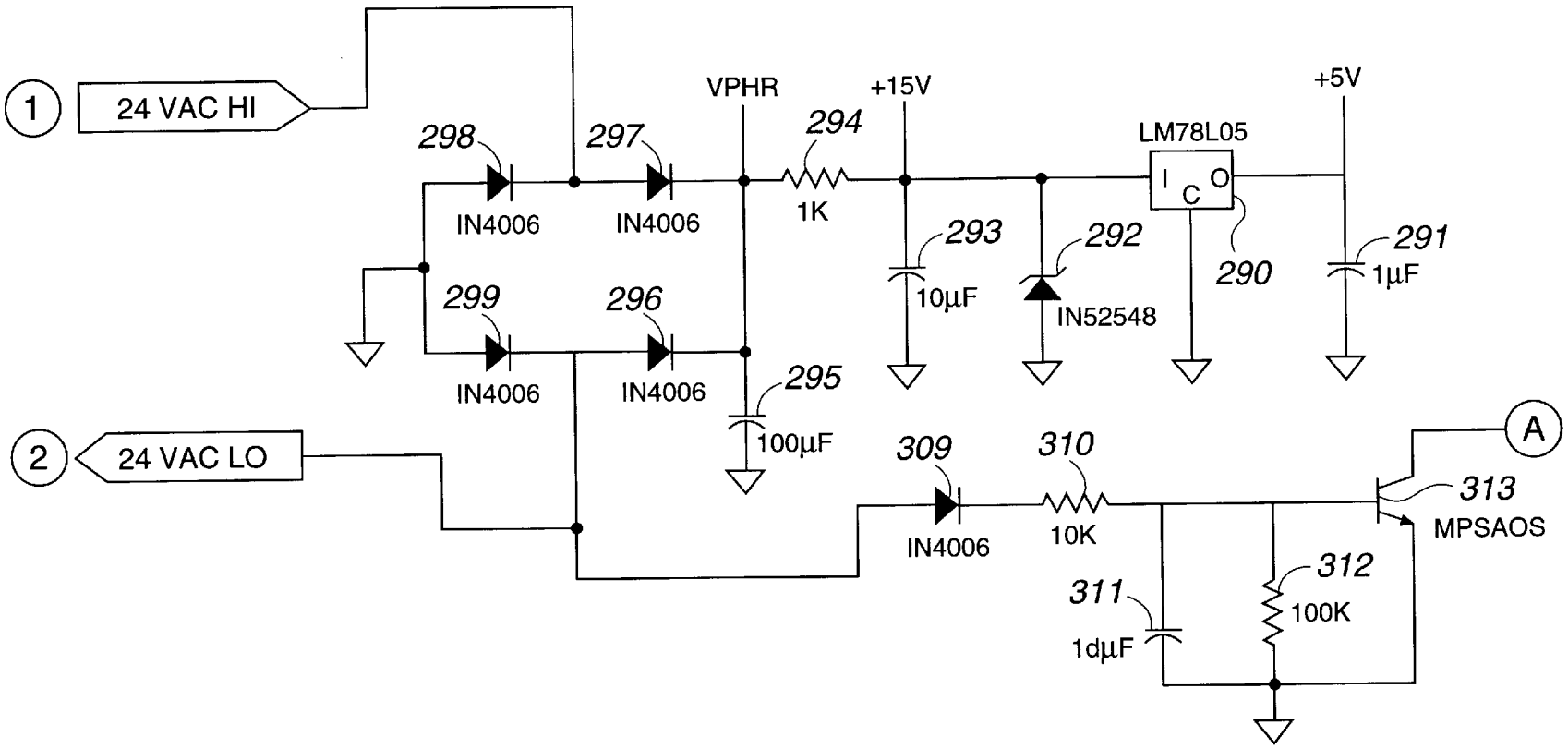
Figure 17B:
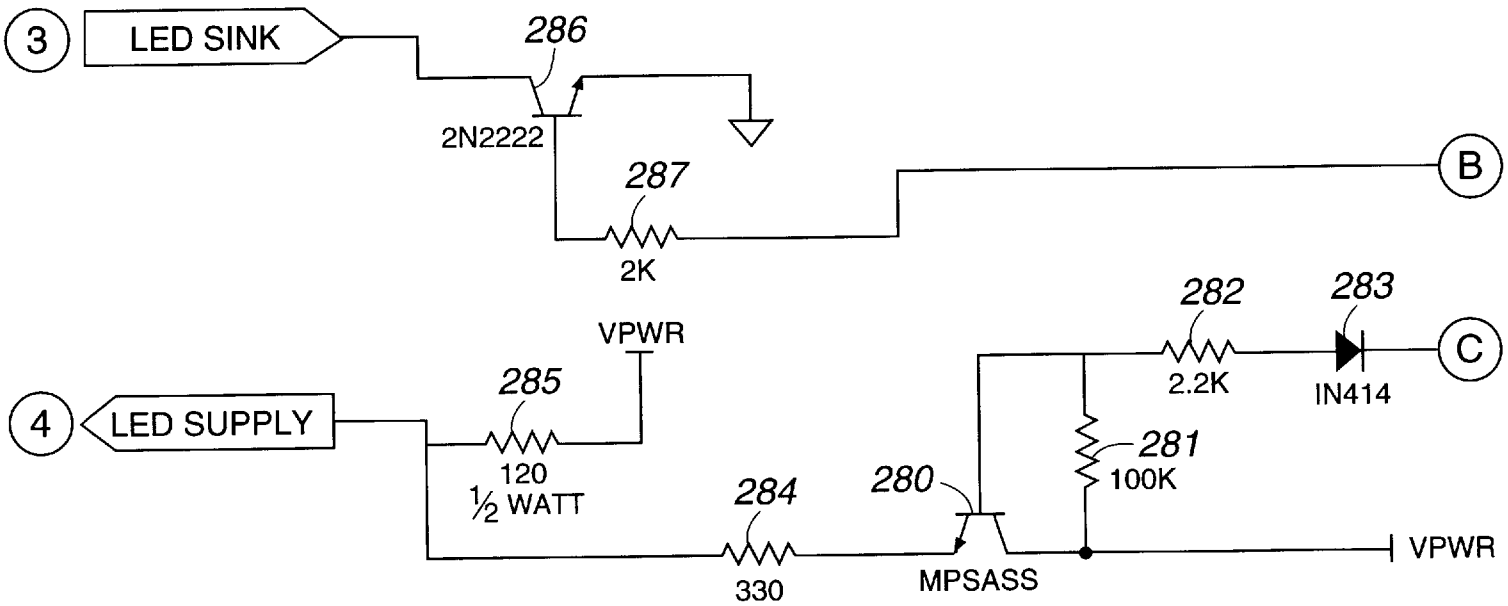
Figure 17C:
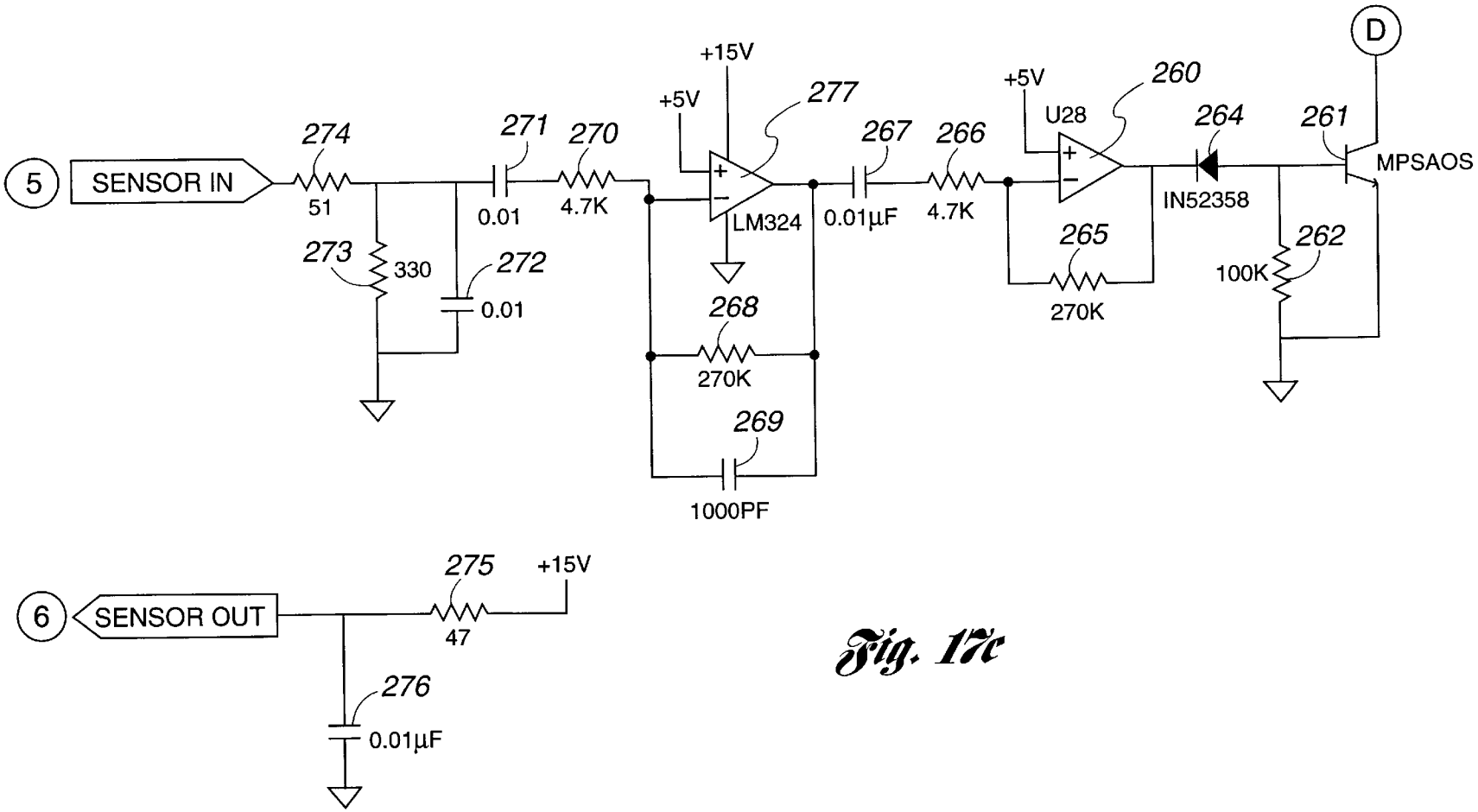
Figure 17B:
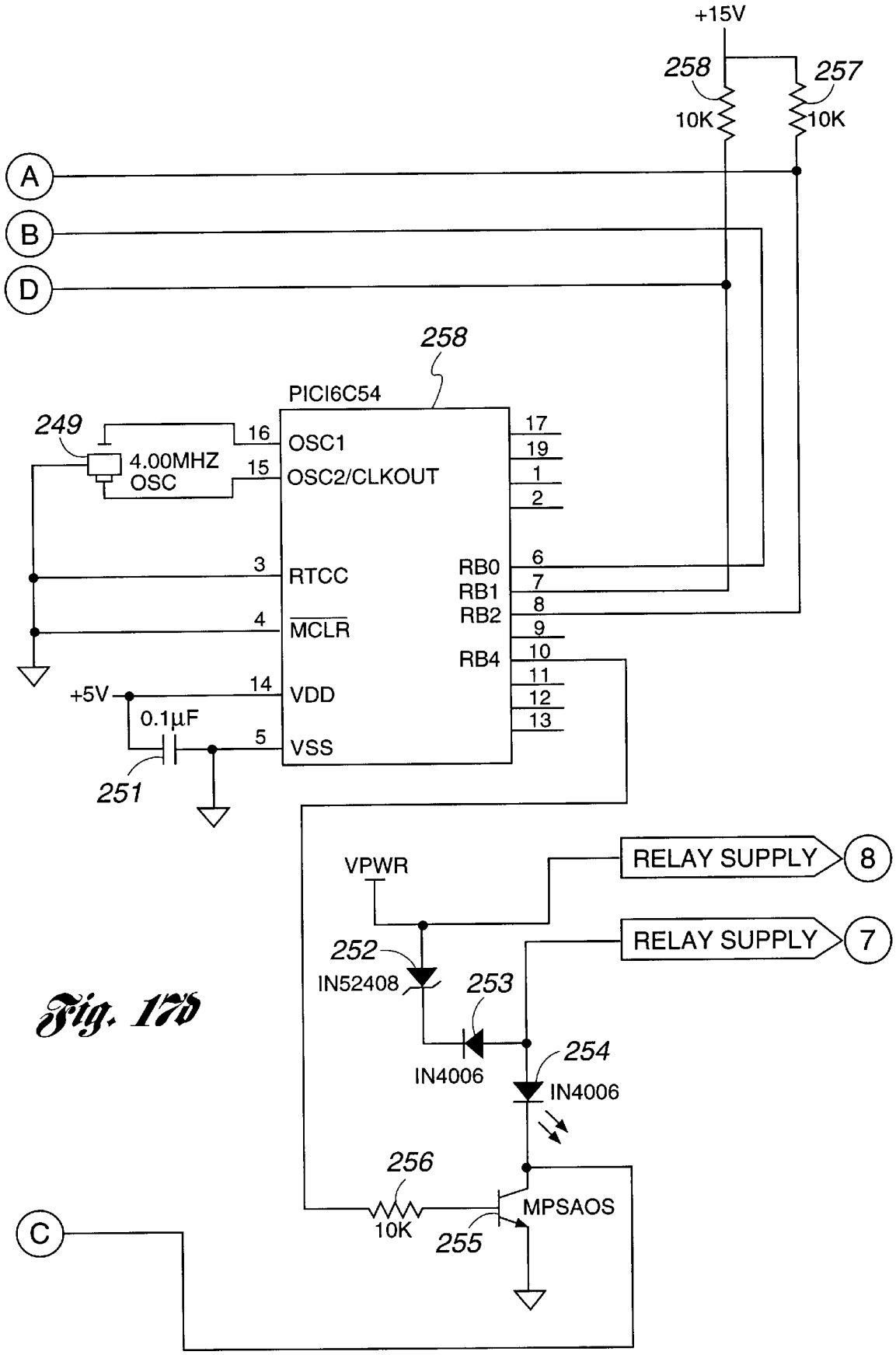
Figure 17E:
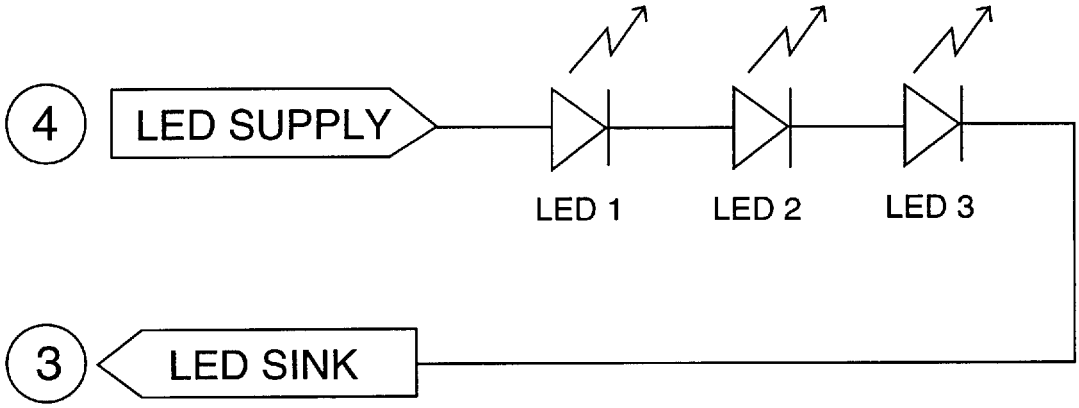

FIGS. 17A–17E provide a schematic diagram of an embodiment of a control circuit in accordance with the present invention. FIGS. 17A to 17D depict the printed wiring board-based electronic circuitry. FIG. 17E shows schematic circuitry of the infrared emitters mounted in the sensor array housing of FIG. 2.

Inputs and outputs to the control circuit have been sequentially numbered 1 through 8, and have been circled to distinguish them from other referenced numerals in the disclosure. An interfacial connector having eight discrete pins provides external access to the eight inputs and outputs. A complete listing of the eight pin connector designations is provided in Table I.

TABLE I

| FIG. Number | Conn. pin no. | Function |
|---|---|---|
| 17A | 1 | 24 Vac Hi Power |
| 17A | 2 | 24 Vac Lo Power |
| 17B | 3 | LED SINK |
| 17B | 4 | LED SUPPLY |
| 17C, 17E | 5 | SENSOR IN |
| 17C, 17E | 6 | SENSOR OUT |
| 17D | 7 | RELAY POWER SUPPLY |
| 17D | 8 | RELAY POWER SUPPLY |

FIG. 17A illustrates a power supply circuit within the control circuit. A 24 VAC source supplied by the dispensing appliance is received along connector pins 1 and 2. Diodes 296, 297, 298, and 299 rectify the 24 VAC input to a DC (direct current) voltage level at the VPWR line. The DC voltage at the VPWR line is made available for relay output and dispenser actuation at connector output pin 8 of FIG. 17D. The VPWR line is also coupled, through a resistor 285, to connector pin 4 of an infrared emitter diode drive circuit of FIG. 17B.

Referring back to FIG. 17A, a combination of a Zener diode 292, a capacitor 293, and a resistor 294 act to regulate the voltage at the VPWR line to +15 VDC. The regulated +15 VDC is used for driving phototransistor sensing circuits in FIG. 17C. More specifically, the +15 VDC is applied to a resistor 275 and an operational amplifier 277 in FIG. 17C.

A voltage regulator 290 is provided to produce a 5 VDC source from the 15 VDC source formed above. An output capacitor 291 filters the 5 VDC output of the voltage regulator 290. The 5 VDC source is used to power a microprocessor 250 illustrated in FIG. 17D.

Still referring to FIG. 17A, a zero-crossing detection circuit is formed by a diode 309, a resistor 310, a capacitor 311, a resistor 312, and a switching transistor 313. The zero-crossing detection circuit detects zero crossings of the 24 VAC input signal received at connector pin 2. Every half cycle of alternating current through this circuit path provides the microprocessor 250 with a pulse representing a 60 Hz timing function.

FIG. 17B depicts a drive circuit for the infrared emitter diode array of FIG. 17E. The infrared emitter diode array comprises a series connection of three infrared light-emitting diodes LED1, LED2, and LED3 which serve to irradiate the appliance dispenser area with infrared light. A drive signal formed by the drive circuit is coupled to the diode array through connector pins 3 and 4. Functionally, the diodes are driven by pulses having a low duty cycle of 2% on-time. The pulses are repeated at a frequency of 200 hertz. The resulting 200 Hz pulse is of a short duration but high current for sensing container edge presentation. Emitter diode drive power is supplied through the resistor 285 from the VPWR line of FIG. 17A.

Referring to FIG. 17B, a transistor 286 is switched on and off by pin 6 of the microprocessor 250 through a resistor 287. The transistor 286 is switched on and off at the pulsed frequency to effect current sink control to the circuit ground for completing the emitter diode drive circuit. Additional drive circuitry comprised of a transistor 280 and resistors 281, 282 and 284 switch the VPWR line through a circuit coupling for sourcing relay power for dispenser actuation.

This supplemental emitter drive circuit compensates for any supply voltage drop which potentially may be encountered in the emitter diode drive circuitry during the dispenser actuation cycle.

FIG. 17C illustrates a signal sense circuit which receives an input from a combination of phototransistors through connector pins 5 and 6. In general, any suitable combination of the phototransistors can be utilized, such as those illustrated in FIGS. 4 to 6. However, for this embodiment of the control circuit, the parallel combination in FIG. 4 is selected. Here, the terminal 103 is coupled to the connector pin 6 and the terminal 116 is coupled to the connector pin 5. The combination of phototransistors serve to receive the infrared radiation generated by the emitter diode array of FIG. 17E and reflected from the receiving member 34.

The signal sense circuit of FIG. 17C amplifies the signal received from the combination of phototransistors, and converts the signal to a logic level for input into the microprocessor 250 of FIG. 17D. Operational amplifiers (op-amps) 260 and 277 serve as AC-coupled inverting amplifiers. The +15 VDC supply voltage from FIG. 17A is applied to the op-amp 260. The +5 VDC supply voltage from FIG. 17A is applied to both op-amp 260 and 277. AC coupling is accomplished through RC circuits comprised of a resistor 270 and a capacitor 271 for the op-amp 277, and a resistor 266 and a capacitor 267 for the op-amp 260.

The gain characteristics of the amplifiers formed by op-amps 277 and 260 are tuned to maximize an amplification at the frequency at which the emitter diode array is pulsed. Direct current and higher frequencies are attenuated and essentially filtered out. The gain characteristic of the amplifier formed by the op-amp 277 can be set through a resistor 268 and a capacitor 269. The gain characteristic of the amplifier formed by the op-amp 260 can be controlled by a resistor 265.

A transistor 261, a Zener diode 264, and resistors 262 and 263 effect the conversion of an amplified analog voltage (from the output of the op-amp 260) to a logical digital signal input. The logical digital signal input is directed to input pin 7 of the microprocessor 250 in FIG. 17D.

The regulated +15 VDC is coupled to the phototransistor combination (via connector pin 6) by a resistor 275 and a capacitor 276. Once powered, the combination of phototransistors produces a pulse train signal when an object is in proximity thereto. The pulse train signal is coupled through connector pin 5 to the amplifier/analog-to-digital circuits in FIG. 17C.

By applying a constant voltage across the phototransistor combination, small changes in current through the phototransistor combination can be sensed across a resistor 273 in FIG. 17C. The combination of AC coupling and constant voltage supply also serves to maintain operation of the phototransistor array within a linear region of gain characteristic.

The use of the parallel combination of phototransistors is advantageous in that only one set of amplifiers (such as those shown in FIG. 17C) is required. As a result, a relatively inexpensive approach to processing reflected signals is provided. Further, by driving the emitter diodes in series, a single drive circuit (such as one shown in FIG. 17B) can be utilized. This provides a relatively inexpensive approach to illuminating the container area.

FIG. 17D illustrates the interconnection of the microprocessor 250 with the remainder of the control circuit. The microprocessor 250, which is an 8-bit PIC16C54 in this embodiment, includes a read-only memory which contains a software program for directing the basic operations of the control circuit. In particular, the microprocessor 250 is operative to control the radiation of the infrared emitter diode array of FIG. 17E, to receive the processed output of the signal sense circuit of FIG. 17C, and to control an application of power to connector pins 7 and 8 to actuate an off-board actuator in the dispensing apparatus. The off-board actuator can include, for example, a relay coil and dispenser solenoid which act to initiate and inhibit dispensing of the material through the dispensing outlet 32.

More specifically, when a condition consistent with the receiving member 34 being in a receiving position under the dispensing outlet is encountered and confirmed, the microprocessor 250 switches on a transistor 255 through pin 10 to supply actuator power at connector output pins 7 and 8. The actuator power initiates dispensing of the material through the dispensing outlet 32. Protection diodes 252 and 253 are provided to control potential transients generated by a field collapse associated with output relay turnoff during dispensing termination. Light emitting diode 254 is provided as a visual indicator of when dispensing is actuated.

The microprocessor 250 is further operative to disable dispensing for a predetermined duration if input pin 8 of the microprocessor 250 senses a loss of power supplied through connector pins 1 and 2 of FIG. 17A. This feature allows for dispenser appliance maintenance without having to remove supplied power for an extended period of time. A few seconds of power loss is sufficient to disable dispenser actuation. In a preferred embodiment, the predetermined time duration over which dispensing is disabled is 120 seconds.

The microprocessor 250 is further operative to govern a prioritization for pulsing the infrared emitter diodes. More specifically, the effective on-time for the pulses is increased when the dispenser is actuated. This provides for enhanced sensitivity and hysteresis in order to detect if the receiving member 34 is removed during dispensing. In a preferred embodiment, the emitter diode pulse on-time is increased by approximately 50% with dispenser actuation. Here, the resulting sensitivity to detecting the removal of the receiving member 34 from the dispenser is approximately doubled.

The microprocessor 250 is also operative to incorporate a default timeout for dispensing termination if the receiving member 34 is not removed by a predetermined time interval. This feature is effective in avoiding overfills of the receiving member 34.

Embodiments of the present invention, being contact-free and automatically controlled, eliminates the waste generated with overfills and unsanitary conditions introduced through contact with the dispensing device.

It is noted that for the embodiments using explicit AND logic circuits and feedback from a reference sensor, the electronics means therefor can be readily implemented by those skilled in the art of electronics.

It is further noted that for all of the embodiments described herein, the use of recesses of varying depth may not be required to control the angles of illumination and/or the angles of view. For example, all of the recesses may have the same depth, but have varying aperture widths to effectuate the same result. Further, some emitters have a limited solid angle of emission which is built-in. Also, optical sensors can have some directionality in their sensitivity. In these cases, it is only necessary to control the alignment of the emitters and/or the optical sensors to manipulate the regions of sensitivity.

It situations where two or more dispensing appliances are to be controlled by a corresponding two or more sensing arrays, it may be required to drive the illumination sources in one sensing array only upon extinguishing of the illumination sources in another sensing array. A sequential use of the two or more sensing arrays is helpful in avoiding false detections of a receiving member, which could otherwise occur.

While the best mode for carrying out the invention has been described in detail, those familiar with the art to which this invention relates will recognize various alternative designs and embodiments for practicing the invention as defined by the following claims.

What is claimed is:

1. A system for controlling a dispensing apparatus having a dispensing outlet located above a receiving position, the system comprising:

a first illumination source for radiating energy in a first field of illumination;

a second illumination source for radiating energy in a second field of illumination, the second field of illumination intersecting the first field of illumination to create an intersection region at the receiving position;

at least one optical sensor; and a control circuit coupled to the at least one optical sensor to initiate dispensing of a material through the dispensing outlet when the at least one optical sensor senses a receiving member positioned within the intersection region based on an intensity of the energy from the first and second illumination sources reflected from the receiving member.

2. The system of claim 1 wherein the first illumination source, the second illumination source, and the at least one optical sensor are located adjacent to the dispensing outlet.

3. The system of claim 2 wherein the first illumination source, the second illumination source, and the at least one optical sensor are located behind the dispensing outlet with respect to a direction of presentation of the receiving member.

4. The system of claim 1 wherein the control circuit initiates dispensing of the material when a current through the at least one optical sensor exceeds a first threshold.

5. The system of claim 4 wherein the control circuit commands an increased illumination of at least one of the first illumination source and the second illumination source when the current exceeds a second threshold, wherein the second threshold is less than the first threshold.

6. The system of claim 4 wherein the control circuit commands an increased illumination of at least one of the first illumination source and the second illumination source while dispensing occurs.

7. The system of claim 4 wherein the at least one optical sensor includes a plurality of optical sensors connected in parallel.

8. The system of claim 4 wherein at least one optical sensor includes a plurality of optical sensors connected in series.

9. The system of claim 1 wherein the control circuit is operative to inhibit the dispensing of the material when the portion of the receiving member exits the first field of illumination.

10. The system of claim 1 wherein the control circuit is operative to inhibit the dispensing of the material at a predetermined time duration after initiation.

11. The system of claim 1 wherein the control circuit is powered by a power source provided by the dispensing apparatus.

12. The system of claim 11 wherein the control circuit is operative to disable dispensing for a predetermined time duration if the power source is interrupted.

13. The system of claim 1 wherein the first illumination source includes a first infrared emitter, the second illumination source includes a second infrared emitter, and the at least one optical sensor includes an infrared detector.

14. The system of claim 1 further comprising a reference sensor which senses a direct emission from at least one of the first illumination source and the second illumination source, wherein the control circuit drives at least one of the first illumination source and the second illumination source in dependence upon a signal from the reference sensor.

15. The system of claim 14 wherein the at least one of the first illumination source and the second illumination source is driven to provide a predetermined signal level in the reference sensor to regulate the illumination intensity.

16. The system of claim 1 wherein the at least one optical sensor includes a first pair of optical sensors located on opposite sides of the first illumination source, and a second pair of optical sensors located on opposite sides of the second illumination source.

17. The system of claim 1 wherein the first field of illumination spans a first solid angle and the second field of illumination spans a second solid angle, wherein the second solid angle is greater than the first solid angle.

18. A system for controlling a dispensing apparatus having a dispensing outlet, the system comprising:

a first illumination source having a first field of illumination;

a second illumination source having a second field of illumination;

a first pair of optical sensors located on opposite sides of the first illumination source, and a second pair of optical sensors located on opposite sides of the second illumination source; and a control circuit responsive to the first and second pairs of optical sensors to initiate dispensing of a material through the dispensing outlet when the first and second optical sensors sense a receiving member positioned within the first field of illumination and the second field of illumination.

19. The system of claim 18 wherein the first field of illumination spans a first solid angle and the second field of illumination spans a second solid angle, wherein the second solid angle is greater than the first solid angle.

20. The system of claim 19 wherein the first solid angle and the second solid angle are dependent upon a depth of mounting of the first illumination source and the second illumination source within a first recess and a second recess in a housing.

21. The system of claim 19 further comprising a third illumination source having a third field of illumination, wherein the control circuit initiates dispensing of the material when the at least one optical sensor senses a portion of the receiving member positioned within the first field of illumination, the second field of illumination, and the third field of illumination.

22. The system of claim 21 wherein the third field of illumination spans a third solid angle which is greater than the first solid angle.

23. The system of claim 22 wherein the third solid angle is less than the second solid angle.

24. The system of claim 18 wherein the control circuit initiates dispensing of the material when a current through the first and second pairs of optical sensors exceeds a first threshold and wherein the control circuit commands an increased illumination of at least one of the first illumination source and the second illumination source when the current exceeds a second threshold, wherein the second threshold is less than the first threshold.

25. The system of claim 24 wherein the control circuit commands an increased illumination of at least one of the first illumination source and the second illumination source while dispensing occurs.

26. The system of claim 25 wherein the increased illumination is provided by increasing a duty cycle at which at least one of the first illumination source and the second illumination source is driven.

27. The system of claim 24 wherein the first and second pairs of optical sensors are connected in parallel.

28. The system of claim 24 wherein the first and second pairs of optical sensors are connected in series.

29. A system for controlling a dispensing apparatus having a dispensing outlet, the system comprising:

a first illumination source having a first field of illumination;

a second illumination source having a second field of illumination;

at least one second optical sensor;

a control circuit coupled to the at least one optical sensor to initiate dispensing of a material through the dispensing outlet when the at least one optical sensor senses a receiving member positioned within the first field of illumination and the second field of illumination; and a second system for controlling a second dispensing apparatus having a second dispensing outlet comprising a third illumination source having a third field of illumination, wherein at least one of the first illumination source and the second illumination source is driven upon extinguishing of the third illumination source of the second system.

30. A method of controlling a dispensing apparatus having a dispensing outlet located above a receiving position, the method comprising the steps of:

providing a first illumination source for radiating energy in a first field of illumination;

providing a second illumination source for radiating energy in a second field of illumination, the second field of illumination intersecting the first field of illumination to create an intersection region at the receiving position;

providing at least one optical sensor; and initiating a dispensing of a material through the dispensing outlet when the at least one optical sensor senses a receiving member positioned within the intersection region based on an intensity of the energy from the first and second illumination sources reflected from the receiving member.

31. The method of claim 30 wherein the first illumination source, the second illumination source, and the at least one optical sensor are located adjacent to the dispensing outlet.

32. The method of claim 31 wherein the first illumination source, the second illumination source, and the at least one optical sensor are located behind the dispensing outlet with respect to a direction of presentation of the receiving member.

33. The method of claim 30 wherein the dispensing is initiated when a current through the first and second pairs of optical sensors exceeds a first threshold.

34. The method of claim 33 further comprising the step of increasing an illumination intensity of at least one of the first illumination source and the second illumination source when the current exceeds a second threshold, wherein the second threshold is less than the first threshold.

35. The method of claim 33 further comprising the step of increasing an illumination intensity of at least one of the first illumination source and the second illumination source while dispensing occurs.

36. The method of claim 33 wherein the at least one optical sensor includes a plurality of optical sensors connected in parallel interconnection.

37. The method of claim 33 wherein the at least one optical sensor includes a plurality of optical sensors connected in series.

38. The method of claim 30 further comprising the step of inhibiting the dispensing of the material when the portion of the receiving member exits the first field of illumination.

39. The method of claim 30 further comprising the step of inhibiting the dispensing of the material at a predetermined time duration after initiation.

40. The method of claim 30 further comprising the step of powering a control circuit by a power source provided by the dispensing apparatus.

41. The method of claim 40 wherein the control circuit is operative to disable dispensing for a predetermined time duration if the power source is interrupted.

42. The method of claim 30 wherein the first illumination source includes a first infrared emitter, the second illumination source includes a second infrared emitter, and the at least one optical sensor includes an infrared detector.

43. The method of claim 30 further comprising the steps of:

providing a reference sensor which senses a direct emission from at least one of the first illumination source and the second illumination source; and driving at least one of the first illumination source and the second illumination source in dependence upon a signal from the reference sensor.

44. The method of claim 43 wherein the at least one of the first illumination source and the second illumination source is driven to provide a predetermined signal level in the reference sensor.

45. The method of claim 30 wherein the at least one optical sensor includes a first pair of optical sensors located on opposite sides of the first illumination source, and a second pair of optical sensors located on opposite sides of the second illumination source.

46. The method of claim 30 wherein the first field of illumination spans a first solid angle and the second field of illumination spans a second solid angle, wherein the second solid angle is greater than the first solid angle.

47. The method of claim 30 further comprising the step of providing a third illumination source independent of the first and second illumination sources wherein at least one of the first illumination source and the second illumination source is driven upon extinguishing of the third illumination source.

48. A method of controlling a dispensing apparatus having a dispensing outlet, the method comprising the steps of:

providing a first illumination source having a first field of illumination;

providing a second illumination source having a second field of illumination;

providing a first pair of optical sensors located on opposite sides of the first illumination source, and a second pair of optical sensors located on opposite sides of the second illumination source; and initiating a dispensing of a material through the dispensing outlet when the first and second pairs of optical sensors sense a receiving member positioned within the first field of illumination and the second field of illumination.

49. The method of claim 48 wherein the first field of illumination spans a first solid angle and the second field of illumination spans a second solid angle, wherein the second solid angle is greater than the first solid angle.

50. The method of claim 49 wherein the first solid angle and the second solid angle are dependent upon a depth of mounting of the first illumination source and the second illumination source within a first recess and a second recess in a housing.

51. The method of claim 49 further comprising the step of:

providing a third illumination source having a third field of illumination;

wherein the step of initiating the dispensing of the material occurs when the at least one optical sensor senses a portion of the receiving member positioned within the first field of illumination, the second field of illumination, and the third field of illumination.

52. The method of claim 51 wherein the third field of illumination spans a third solid angle which is greater than the first solid angle.

53. The method of claim 52 wherein the third solid angle is less than the second solid angle.

54. The method of claim 48 wherein the dispensing is initiated when a current through the first and second pairs of optical sensors exceeds a first threshold and further comprising the step of increasing an illumination intensity of at least one of the first illumination source and the second illumination source when the current exceeds a second threshold, wherein the second threshold is less than the first threshold.

55. The method of claim 54 further comprising the step of increasing an illumination intensity of at least one of the first illumination source and the second illumination source while dispensing occurs.

56. The method of claim 55 wherein the illumination intensity is increased by increasing a duty cycle at which at least one of the first illumination source and the second illumination source is driven.

57. The system of claim 54 wherein the first and second pairs of optical sensors are connected in parallel.

58. The system of claim 54 wherein the first and second pairs of optical sensors are connected in series.

59. A method for controlling a dispensing apparatus having a dispensing outlet, the method comprising:

providing a first illumination source having a first field of illumination;

providing a second illumination source having a second field of illumination;

providing at least one second optical sensor;

initiating a dispensing of a material through the dispensing outlet when the at least one optical sensor senses a receiving member positioned within the first field of illumination and the second field of illumination; and providing a third illumination source independent of the first and second illumination sources having a third field of illumination, wherein at least one of the first illumination source and the second illumination source is driven upon extinguishing of the third illumination source.

60. A system for controlling a dispensing apparatus having a dispensing outlet located above a receiving position, the system comprising:

at least one illumination source for radiating energy;

a first optical sensor having a first field of view;

a second optical sensor having a second field of view, the second field of view intersecting the first field of view to create an intersection region at the receiving position; and a control circuit responsive to the first optical sensor and the second optical sensor to initiate dispensing of a material through the dispensing outlet when a receiving member is sensed within the intersection region based on an intensity of the energy from the at least one illumination source reflected from the receiving member.

61. The system of claim 60 wherein the first field of view spans a first solid angle and the second field of view spans a second solid angle, wherein the second solid angle is greater than the first solid angle.

62. The system of claim 61 wherein the first solid angle and the second solid angle are dependent upon a depth of mounting of the first optical sensor and the second optical sensor within a first recess and a second recess in a housing.

63. The system of claim 61 further comprising a third optical sensor having a third field of view, wherein the control circuit initiates dispensing of the material when a portion of the receiving member is sensed within the first field of view, the second field of view, and the third field of view.

64. The system of claim 63 wherein the third field of view spans a third solid angle which is greater than the first solid angle.

65. The system of claim 64 wherein the third solid angle is less than the second solid angle.

66. The system of claim 60 wherein the first optical sensor, the second optical sensor, and the at least one illumination source are located adjacent to the dispensing outlet.

67. The system of claim 66 wherein the first optical sensor, the second optical sensor, and the at least one illumination source are located behind the dispensing outlet with respect to a direction of presentation of the receiving member.

68. The system of claim 60 further comprising an interconnection of the first and second optical sensors which provides a current indicative of the location of the receiving member and wherein the dispensing of the material is initiated when the current through the interconnection exceeds a first threshold.

69. The system of claim 68 wherein the control circuit commands an increased illumination of the at least one illumination source when the current exceeds a second threshold, wherein the second threshold is less than the first threshold.

70. The system of claim 68 wherein the control circuit commands an increased illumination of the at least one illumination source while dispensing occurs.

71. The system of claim 68 wherein the first and second optical sensors are connected in parallel.

72. The system of claim 68 wherein the first and second optical sensors are connected in series.

73. The system of claim 60 wherein the control circuit is operative to inhibit the dispensing of the material when the portion of the receiving member exits the first field of view.

74. The system of claim 60 wherein the control circuit is operative to inhibit the dispensing of the material at a predetermined time duration after initiation.

75. The system of claim 60 wherein the control circuit is powered by a power source provided by the dispensing apparatus.

76. The system of claim 75 wherein the control circuit is operative to disable dispensing for a predetermined time duration if the power source is interrupted.

77. The system of claim 60 wherein the at least one illumination source includes an infrared emitter, the first optical sensor includes a first infrared detector, and the second optical sensor includes a second infrared detector.

78. The system of claim 60 further comprising a reference sensor which senses a direct emission from the at least one illumination source, wherein the control circuit drives the at least one illumination source in dependence upon a signal from the reference sensor.

79. The system of claim 78 wherein the at least one illumination source is driven to provide a predetermined signal level in the reference sensor to regulate the illumination intensity.

80. The system of claim 60 wherein the first optical sensor and the second optical sensor are located on opposite sides of the at least one illumination source.

81. A system for controlling a dispensing apparatus having a dispensing outlet, the system comprising:

at least one illumination source;

a first optical sensor having a first field of view;

a second optical sensor having a second field of view, wherein the first optical sensor and the second optical sensor are located on opposite sides of the at least one illumination source; and a control circuit coupled to the first optical sensor and the second optical sensor to initiate dispensing of a material through the dispensing outlet when a receiving member is sensed by one of the first and second optical sensors within the first field of view and the second field of view.

82. The system of claim 81 wherein the control circuit initiates dispensing of the material when a current through the first and second optical sensors exceed a first threshold and further commands an increased illumination of the at least one illumination source when the current through the first optical sensor and the second optical sensor exceeds a second threshold, wherein the second threshold is less than the first threshold.

83. The system of claim 82 wherein the control circuit commands an increased illumination of the at least one illumination source while dispensing occurs.

84. The system of claim 83 wherein the increased illumination is provided by increasing a duty cycle at which the at least one illumination source is driven.

85. The system of claim 82 wherein the first and second optical sensors are connected in parallel.

86. The system of claim 82 wherein the first and second optical sensors are connected in series.

87. A system for controlling a dispensing apparatus having a dispensing outlet, the system comprising:

at least one illumination source;

a first optical sensor having a first field of view;

a second optical sensor having a second field of view;

a control circuit coupled to the first optical sensor and the second optical sensor to initiate dispensing of a material through the dispensing outlet when a receiving member is sensed by one of the first and second optical sensors within the first field of view and the second field of view; and a second system for controlling a dispensing apparatus having a dispensing outlet and a second illumination source, wherein the at least one illumination source is driven upon extinguishing of the second illumination source of the second system.

88. A method of controlling a dispensing apparatus having a dispensing outlet located above a receiving position, the method comprising the steps of:

providing at least one illumination source for radiating energy;

providing a first optical sensor having a first field of view;

providing a second optical sensor having a second field of view, the second field of view intersecting the first field of view to create an intersection region at the receiving position; and initiating a dispensing of a material through the dispensing outlet when a receiving member is sensed within the intersection region based on an intensity of the energy reflected from the at least one illumination source reflected from the receiving member.

89. The method of claim 88 wherein the first field of view spans a first solid angle and the second field of view spans a second solid angle, wherein the second solid angle is greater than the first solid angle.

90. The method of claim 89 wherein the first solid angle and the second solid angle are dependent upon a depth of mounting of the first optical sensor and the second optical sensor within a first recess and a second recess in a housing.

91. The method of claim 89 further comprising the step of:

providing a third optical sensor having a third field of view;

wherein the step of initiating the dispensing of the material occurs when a portion of the receiving member is sensed within the first field of view, the second field of view, and the third field of view.

92. The method of claim 91 wherein the third field of view spans a third solid angle which is greater than the first solid angle.

93. The method of claim 92 wherein the third solid angle is less than the second solid angle.

94. The method of claim 88 wherein the first optical sensor, the second optical sensor, and the at least one illumination source are located adjacent to the dispensing outlet.

95. The method of claim 94 wherein the first optical sensor, the second optical sensor, and the at least one illumination source are located behind the dispensing outlet with respect to a direction of presentation of the receiving member.

96. The method of claim 88 wherein the dispensing of the material is initiated when a current through the first optical sensor and the second optical sensor exceeds a first threshold.

97. The method of claim 96 further comprising the step of increasing an illumination intensity of the at least one illumination source when the current exceeds a second threshold, wherein the second threshold is less than the first threshold.

98. The method of claim 96 further comprising the step of increasing an illumination intensity of the at least one illumination source while dispensing occurs.

99. The method of claim 96 wherein the first and second optical sensors are connected in parallel.

100. The method of claim 96 wherein the first and second optical sensors are connected in series.

101. The method of claim 88 further comprising the step of inhibiting the dispensing of the material when the portion of the receiving member exits the first field of view.

102. The method of claim 88 further comprising the step of inhibiting the dispensing of the material at a predetermined time duration after initiation.

103. The method of claim 88 further comprising the step of powering a control circuit by a power source provided by the dispensing apparatus.

104. The method of claim 103 wherein the control circuit is operative to disable dispensing for a predetermined time duration if the power source is interrupted.

105. The method of claim 88 wherein the at least one illumination source includes an infrared emitter, the first optical sensor includes a first infrared detector, and the second optical sensor includes a second infrared detector.

106. The method of claim 88 further comprising the steps of:

providing a reference sensor which senses a direct emission from the at least one illumination source; and driving the at least one illumination source in dependence upon a signal from the reference sensor.

107. The method of claim 106 wherein the at least one illumination source is driven to provide a predetermined signal level in the reference sensor to regulate the illumination intensity.

108. The method of claim 88 wherein the first optical sensor and the second optical sensor are located on opposite sides of the at least one illumination source.

109. The method of claim 88 further comprising the step of providing a second illumination source independent of the at least one illumination source wherein the at least one illumination source is driven upon extinguishing of the second illumination source.

110. A method of controlling a dispensing apparatus having a dispensing outlet, the method comprising the steps of:

providing at least one illumination source;

providing a first optical sensor having a first field of view;

providing a second optical sensor having a second field of view, wherein the first optical sensor and the second optical sensor are located on opposite sides of the at least one illumination source; and initiating a dispensing of a material through the dispensing outlet when a receiving member is sensed by one of the first and second optical sensors within the first field of view by the first optical sensor and within the second field of view by the second optical sensor.

111. The method of claim 110 wherein the dispensing of the material is initiated when a current through the first and second optical sensors exceeds a first threshold and further comprising the step of increasing an illumination intensity of the at least one illumination source when the current through the first optical sensor and the second optical sensor exceeds a second threshold, wherein the second threshold is less than the first threshold.

112. The method of claim 111 further comprising the step of increasing an illumination intensity of the at least one illumination source while dispensing occurs.

113. The method of claim 112 wherein the illumination intensity is increased by increasing a duty cycle at which the at least one illumination source is driven.

114. The system of claim 111 wherein the first and second optical sensors are connected in parallel.

115. The system of claim 111 wherein the first and second optical sensors are connected in series.

116. A method for controlling a dispensing apparatus having a dispensing outlet, the method comprising:

providing at least one illumination source;

providing a first optical sensor having a first field of view;

providing a second optical sensor having a second field of view;

initiating a dispensing of a material through the dispensing outlet when a receiving member is sensed within the first field of view by the first optical sensor and within the second field of view by the second optical sensor; and providing a second illumination source independent of the at least one illumination source, wherein the at least one illumination source is driven upon extinguishing of the second illumination source.

* * * * *